US009844103B2

(12) United States Patent
Hirukawa et al.

(10) Patent No.: US 9,844,103 B2
(45) Date of Patent: Dec. 12, 2017

(54) COOKING ASSISTANCE DEVICE, COOKING ASSISTANCE METHOD, AND COOKING ASSISTANCE SYSTEM

(71) Applicant: Sharp Kabushiki Kaisha, Osaka-shi, Osaka (JP)

(72) Inventors: Keiko Hirukawa, Osaka (JP); Ataru Okura, Osaka (JP); Misuzu Doi, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 7 days.

(21) Appl. No.: 14/916,225

(22) PCT Filed: Aug. 26, 2014

(86) PCT No.: PCT/JP2014/072218

§ 371 (c)(1),
(2) Date: Mar. 3, 2016

(87) PCT Pub. No.: WO2015/045706

PCT Pub. Date: Apr. 2, 2015

(65) Prior Publication Data

US 2016/0219655 A1 Jul. 28, 2016

(30) Foreign Application Priority Data

Sep. 30, 2013 (JP) ..... 2013-204887

(51) Int. Cl.
*H05B 1/02* (2006.01)
*H05B 6/68* (2006.01)
(Continued)

(52) U.S. Cl.
CPC ..... *H05B 6/687* (2013.01); *H05B 1/0261* (2013.01); *H05B 6/062* (2013.01); *H05B 6/668* (2013.01)

(58) Field of Classification Search
CPC ..... H05B 6/687; H05B 1/0261; H05B 6/062; H05B 6/668; H05B 3/0076; H05B 1/02
(Continued)

(56) References Cited

U.S. PATENT DOCUMENTS 4,375,586 A * 3/1983 Ueda ..... F24C 7/08 219/702
5,189,283 A * 2/1993 Carl, Jr. ..... E21B 36/04 219/497
(Continued)

FOREIGN PATENT DOCUMENTS

JP 11-187824 A 7/1999
JP 2002-310431 A 10/2002
(Continued)

OTHER PUBLICATIONS

Official Communication issued in International Patent Application No. PCT/JP2014/072218, dated Nov. 25, 2014.

*Primary Examiner* — Mark Paschall
(74) *Attorney, Agent, or Firm* — ScienBiziP, P.C.

(57) ABSTRACT

Provided is a cooking assistance device for providing information that assists cooking using a cooking appliance based on a measurement result of power consumption of the cooking appliance. The cooking assistance device includes a storage unit that stores information that relates to power consumption in cooking, an acquisition unit that acquires a measurement value that relates to power consumption of the cooking appliance, and an output unit that outputs the measurement value and the information that relates to power consumption in cooking.

6 Claims, 20 Drawing Sheets

(51) Int. Cl.
*H05B 6/06* (2006.01)
*H05B 6/66* (2006.01)

(58) Field of Classification Search
USPC ..... 219/483, 506, 497, 702, 704, 716, 720
See application file for complete search history.

(56) References Cited

U.S. PATENT DOCUMENTS 5,301,122 A * 4/1994 Halpern ..... G01R 21/133
324/113
5,681,496 A * 10/1997 Brownlow ..... H05B 6/6458
219/482
6,133,555 A * 10/2000 Brenn ..... A47F 10/06
219/483
6,249,710 B1 * 6/2001 Drucker ..... G05D 23/1917
219/702

FOREIGN PATENT DOCUMENTS

JP 2003-307313 A 10/2003
JP 2007-107766 A 4/2007
JP 2009-115364 A 5/2009

* cited by examiner

FIG.8

1000

SIMPLE TASTY CHICKEN PILAF

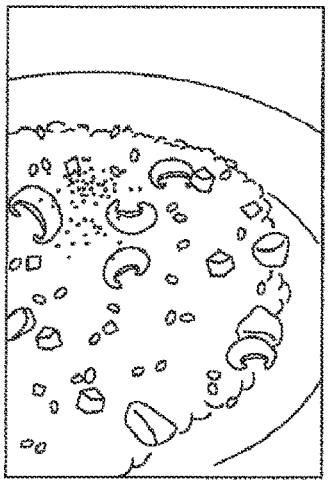

1001

RELATED INFORMATION

GARLIC FLAVOR IRRESISTIBLE CHICKEN PILAF.

INGREDIENTS (SERVES 2)

| | |
|---|---|
| RICE | 2 CUPS |
| CHICKEN | 200 g |
| ONION | 2/3 (70 g) |
| CARROT | 1/3 (40 g) |
| MUSHROOMS | 80 g |
| PEPPERS | 25 g |
| GARLIC | 3 CLOVES |
| BUTTER | 20 g |
| SALAD OIL | 1 TABLESPOON |
| *WATER | 200 cc |
| *WHITE WINE | 50 cc |
| *STOCK | CUBES 2 |
| SALT | A PINCH |
| BLACK PEPPER | A PINCH |

1

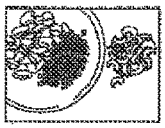

WASH THE RICE AND PUT IT ON THE SIEVE. CUT THE CHICKEN INTO SMALL PIECES. FINELY CHOP THE ONIONS. SLICE THE MUSHROOMS AND GARLIC.

2

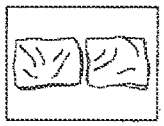

CUT THE CARROTS INTO 6 mm SQUARES, FINELY CHOP THE PEPPERS AND WRAP UP IN DAMP KITCHEN PAPER AND HEAT IN THE MICROWAVE OVEN.

3

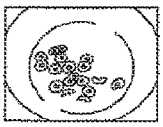

HEAT UP THE BUTTER AND THE SALAD OIL IN A FRYING PAN. ADD THE GARLIC AND FRY AT LOW HEAT.

4

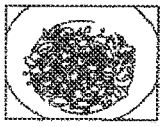

ADD THE ONIONS AND THE CHICKEN AND FRY AT HIGH HEAT.

5

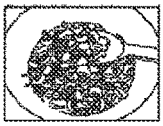

WHEN THE COLOR OF THE CHICKEN STARTS TO CHANGE. ADD THE CARROTS AND MUSHROOMS AND CONTINUE TO FRY.

6

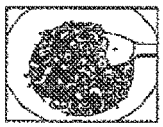

ADD THE RICE AND FRY UNTIL THE RICE BECOMES TRANSPARENT.

7

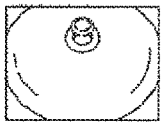

ADD * AND BOIL. SIMMER WITH THE LID ON FOR APPROXIMATELY 10 MINUTES.

8

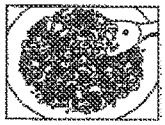

ADD THE PEPPERS, AND ADD SALT AND BLACK PEPPER TO TASTE.

9

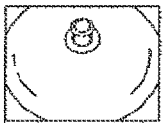

PLACE THE LID AGAIN AND SIMMER FOR APPROXIMATELY 10 MINUTES.

10

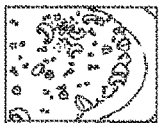

SERVE.

TIP

YOU CAN CHANGE THE VEGETABLES WITH ANY VEGETABLES YOU LIKE.

FIG.10

| | CONTENT | RELATED INFORMATION | MODEL DATA | USER POWER DATA |
|---|---|---|---|---|
| COMMON DATA | Data-G-1 | Data-R-G | Data-TX | Data-U-G |
| PROCEDURE 1 | Data-A-1 | Data-R-1 | Data-T-1 | Data-U-1 |
| PROCEDURE 2 | Data-A-2 | Data-R-2 | Data-T-2 | Data-U-2 |
| PROCEDURE 3 | Data-A-3 | Data-R-3 | Data-T-3 | Data-U-3 |
| PROCEDURE 4 | Data-A-4 | Data-R-4 | Data-T-4 | Data-U-4 |
| : | : | : | : | : |
| PROCEDURE N | Data-A-N | Data-R-N | Data-T-N | Data-U-N |

FIG.17

| | CONTENT | RELATED INFORMATION | MODEL DATA | USER POWER DATA | USER A POWER DATA | : |
|---|---|---|---|---|---|---|
| COMMON DATA | Data-G-1 | Data-R-G | Data-TX | Data-U-G | Data-UA-G | : |
| PROCEDURE 1 | Data-A-1 | Data-R-1 | Data-T-1 | Data-U-1 | Data-UA-1 | : |
| PROCEDURE 2 | Data-A-2 | Data-R-2 | Data-T-2 | Data-U-2 | Data-UA-2 | : |
| PROCEDURE 3 | Data-A-3 | Data-R-3 | Data-T-3 | Data-U-3 | Data-UA-3 | : |
| PROCEDURE 4 | Data-A-4 | Data-R-4 | Data-T-4 | Data-U-4 | Data-UA-4 | : |
| : | : | : | : | : | : | : |
| PROCEDURE N | Data-A-N | Data-R-N | Data-T-N | Data-U-N | Data-UA-N | : |

COOKING ASSISTANCE DEVICE, COOKING ASSISTANCE METHOD, AND COOKING ASSISTANCE SYSTEM

TECHNICAL FIELD

The present disclosure relates to a cooking assistance device, a cooking assistance method, and a cooking assistance system, and in particular, relates to a cooking assistance device and a cooking assistance system for providing information that assists cooking using a cooking appliance based on a measurement result of power consumption of the cooking appliance.

BACKGROUND ART

Information that assists cooking utilizing a cooking appliance such as a microwave oven has been provided in various forms. For example, in Japanese Unexamined Patent Application Publication No. 2007-107766 (PTL 1), an information terminal is disclosed which generates a recipe unique to the cook based on control information such as heating time from the cooking appliance. In Japanese Unexamined Patent Application Publication No. 2002-310431 (PTL 2), a technique is disclosed in which a host computer which stores information on the type of machine of each cooking device and the like provides, to another cooking device, a cooking sequence which is customized to a cooking device by acquiring information on operation content and a state of an object to be heated. In Japanese Unexamined Patent Application Publication No. 11-187824 (PTL 3), a technique is disclosed in which an instruction to proceed to a subsequent cooking step is provided to a heating cooking device in accordance with information on a state of an object to be heated corresponding to the progress of cooking in the heating cooking device.

CITATION LIST

Patent Literature

PTL 1: Japanese Unexamined Patent Application Publication No. 2007-107766.

PTL 2: Japanese Unexamined Patent Application Publication No. 2002-310431.

PTL 3: Japanese Unexamined Patent Application Publication No. 11-187824.

SUMMARY OF INVENTION

Technical Problem

However, the techniques disclosed in PTL 1 to PTL 3 are techniques in which control information of a cooking appliance is generated, but information that is referenced by a user who is cooking is not provided. Meanwhile, in a case where the user performs cooking using the cooking appliance, the user generally desires provision of information according to actual cooking conditions, which is difficult to be provided with a cookery book or the like.

The present disclosure is made in consideration of the above circumstances, and an object thereof is to provide information, according to actual cooking conditions, to a user who is cooking using a cooking appliance.

Solution to Problem

According to an aspect, there is provided a cooking assistance device for providing information that assists cooking using a cooking appliance based on a measurement result of power consumption of the cooking appliance. The cooking assistance device is provided with storage means for storing information which relates to power consumption in cooking, acquisition means for acquiring a measurement value which relates to power consumption of the cooking appliance, and output means for outputting the measurement value and the information which relates to power consumption in cooking.

Preferably the output means is configured to output recipe information. The information which relates to power consumption in cooking is associated with the recipe information. The measurement value is a value which relates to power consumption of the cooking appliance in a period which corresponds to the recipe information.

Preferably, the recipe information includes cooking information on a plurality of procedures. The information which relates to power consumption in cooking includes a value which relates to power consumption that relates to cooking which corresponds to at least one procedure among the plurality of procedures. The acquisition means is configured to acquire a measurement value relating to at least one of the plurality of procedures. The output means is configured to output the recipe information, the information which relates to power consumption in cooking, and the measurement value relating to at least one of the plurality of procedures.

Preferably, the information which relates to power consumption in cooking includes a value which relates to power consumption by each of two or more cooking devices which relate to cooking that corresponds to recipe information. The acquisition means acquires a value which relates to power consumption by each of the two or more cooking devices as the measurement value.

Preferably, information is generated according to the result of a comparison between the measurement value and the information which relates to power consumption in cooking. The output means is configured to further output information according to the comparison result.

According to another aspect, there is provided a cooking assistance method which is executed by a cooking assistance device for providing information that assists cooking using a cooking appliance based on a measurement result of power consumption of the cooking appliance. The cooking assistance device includes storage means for storing information which relates to power consumption in cooking. The method includes the steps of acquiring a measurement value which relates to power consumption of the cooking appliance, and outputting the measurement value and the information which relates to power consumption in cooking.

According to still another aspect, there is provided a cooking assistance device for providing information that assists cooking using a cooking appliance based on a measurement result of power consumption of the cooking appliance. The cooking assistance device includes storage means for storing information which relates to power consumption in cooking, acquisition means for acquiring a measurement value which relates to power consumption of the cooking appliance, and output means for outputting recipe information. The recipe information includes a first procedure and a second procedure which is a subsequent procedure to the first procedure. The output means is configured to output the second procedure in the recipe information after it is determined that the first procedure is complete in the cooking appliance based on comparison between the measurement value and the information which relates to power consumption in cooking.

According to still another aspect, there is provided a cooking assistance device for providing information that assists cooking using a cooking appliance based on a measurement result of power consumption of the cooking appliance. The cooking assistance device includes storage means, acquisition means for acquiring a measurement value which relates to power consumption of the cooking appliance, input means for receiving input of information which specifies recipe information, and control means for storing in the storage means, the measurement value which is acquired by the acquisition means and the recipe information which is input to the input means, while associating the measurement value and the recipe information with each other.

According to still another aspect, there is provided a cooking assistance system for providing information that assists cooking using a cooking appliance based on a measurement result of power consumption of the cooking appliance. The cooking assistance system includes a server, an output device, and a measurement device for measuring power consumption of the cooking appliance. The measurement device includes measurement means for measuring a value which relates to the power consumption of the cooking appliance, and first transmission means for transmitting a measurement result by the measurement means toward the server. The server includes storage means for storing information which relates to power consumption in cooking, acquisition means for acquiring a measurement value which relates to power consumption of the cooking appliance from the measurement result, and second transmission means for transmitting data for outputting the measurement value and the information which relates to power consumption in cooking to the output device.

Advantageous Effects of Invention

According to the present disclosure, it is possible to provide information, according to actual cooking conditions, to a user who is cooking using a cooking appliance.

BRIEF DESCRIPTION OF DRAWINGS

FIG. 8 is a diagram illustrating an example of an image of recipe information which is displayed on the tablet terminal.

FIG. 10 is a diagram illustrating a configuration example of recipe information which is utilized in a first embodiment.

FIG. 17 is a diagram illustrating an example of recipe information which is generated in a fifth embodiment.

DESCRIPTION OF EMBODIMENTS

Figure 1:
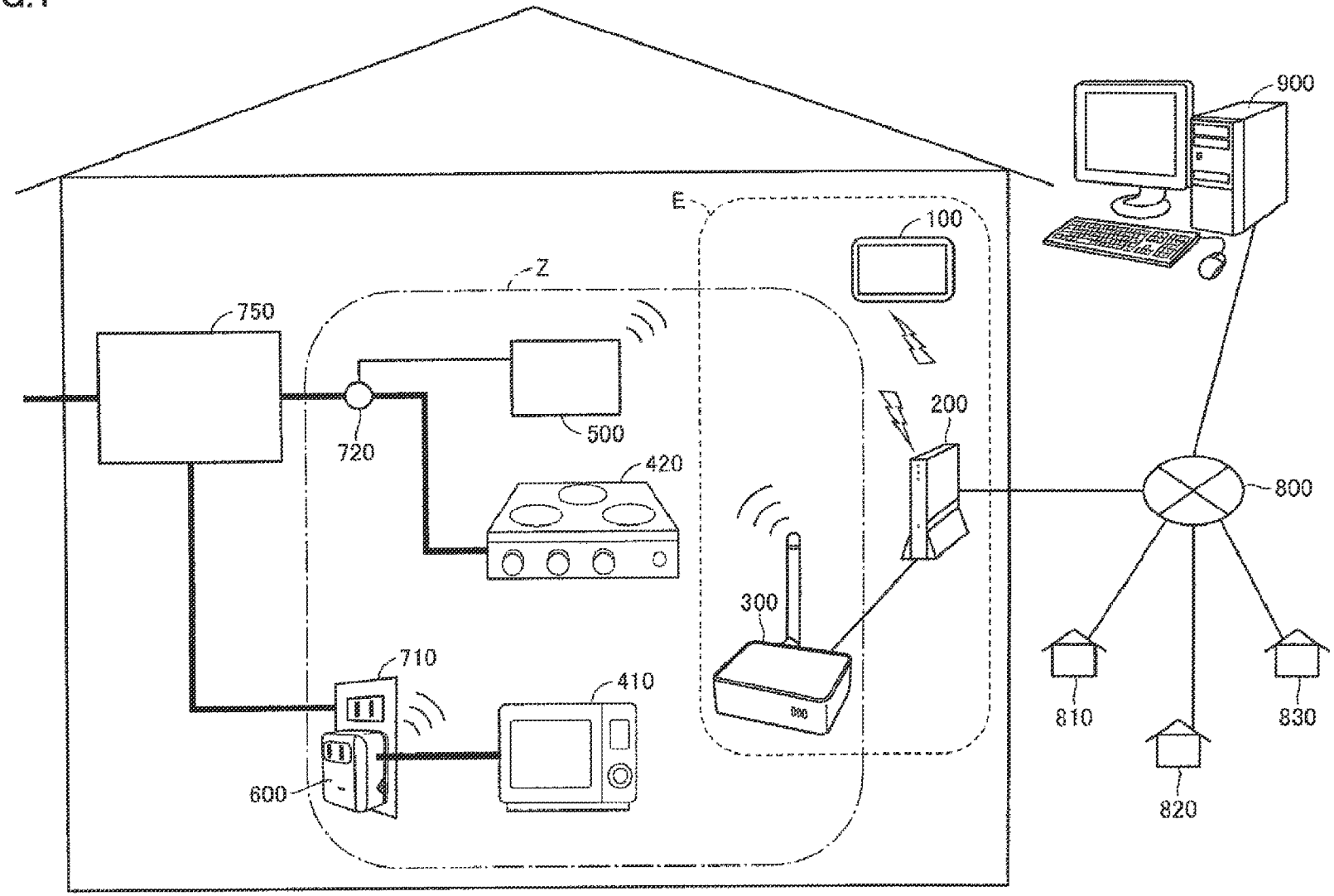
FIG. 1 is a diagram illustrating an outline configuration of a network system.

Embodiments of a cooking assistance device and a cooking assistance system will be described below with reference to the drawings. In the description below, the same components are assigned the same reference numerals. The designations and functions are also the same. Accordingly, detailed description is not repeated.

First Embodiment

<A. Network System Summary>

FIG. 1 is a diagram illustrating an outline configuration of a network system. The network system in FIG. 1 includes a home network Z and a home network E as well as a network 800 outside and a server 900.

In the first embodiment, in the home, a tablet terminal 100 generates information for assisting cooking using a cooking appliance based on a measurement result of power consumption of the cooking appliance such as a microwave oven or an induction heating (IH) cooking appliance. A summary of the configuration of the network system will be described below. In the present specification, a "cooking appliance" may also be referred to as a "cooking device".

An in-home portion within the network system will be described. The network Z indicates a low-speed wireless communication network (for example, ZigBee (registered trademark)). The network E indicates a high-speed communication network (for example, Ethernet (registered trademark), WiFi (registered trademark), or a combination of the two are assumed). Here, in the present example, a network is described using the system described above, but the network is not particularly limited. For example, it is possible to use Z-WAVE (registered trademark), Bluetooth (registered trademark), a specified low-power wireless, or the like in the network Z, in addition, it is also possible to use power line communications (PLC) or the like in the network E.

The network Z includes a repeater 300, a tap 600, and a current transformer (CT) sensor unit 500 (hereinafter referred to as a "sensor unit 500"), and various other appliances. The network E includes the repeater 300 and a broadband router 200 (hereinafter referred to as a "router 200"), and the tablet terminal 100, and various other appliances. The repeater 300 is included in both networks of the network Z and the network E. In addition, the repeater 300 has a hyper text transfer protocol (HTTP) server function. A microwave oven 410 which is an example of the cooking appliance is connected to the tap 600. The tap 600 is a power consumption measuring instrument which measures the power consumption of a connected home appliance (the microwave oven 410), and it is possible to transmit information which represents the measured power consumption to the repeater 300.

A power plug of the microwave oven 410 is plugged into a socket of the tap 600. The tap 600 is attached to an outlet 710 which is installed in the home. The outlet 710 is connected to a switchboard 750. Thereby, the tap 600 is fed power via the outlet 710. In addition, the microwave oven 410 is fed power via the outlet 710 and the tap 600.

The power plug of an IH cooker 420 is attached to the outlet (not shown in the diagram) which is connected to the switchboard 750. Thereby, the IH cooker 420 is fed power via the outlet. A CT sensor 720 is attached on a circuit between the outlet and the switchboard 750. The CT sensor 720 measures a current value which is supplied to the IH cooker 420, and is wiredly or wirelessly connected to the sensor unit 500. In the system in FIG. 1, a value of power which is supplied to the IH cooker 420 is calculated based on the current value which is detected by the CT sensor 720. The calculation of the value of the power is executed in, for example, the CT sensor 720, the sensor unit 500, the tablet terminal 100, or the server 900.

Each of the repeater 300, the sensor unit 500, and the tap 600 is provided with a low-speed wireless communication module. The low-speed wireless communication network Z (hereinafter referred to simply as the "network Z") includes the repeater 300, the sensor unit 500, and the tap 600. The repeater 300 is connected to the router 200 using Ethernet, functions as a bridge (media conversion device) or a gateway (protocol conversion device) between the network Z and the network E, and performs low-speed wireless communication between the sensor unit 500 and the tap 600.

The tablet terminal 100 performs communication with the repeater 300 via the router 200. The tablet terminal 100 is connected to the router 200 using WiFi. Here, the tablet terminal 100 may be connected to the router 200 using Ethernet.

The tablet terminal 100 is able to perform various display which relates to the power consumption of the home appliance such as the microwave oven 410 or the IH cooker 420. The various display includes display of the value of the power consumption of each home appliance.

An example which uses ZigBee, as the network Z, that is one short-range wireless communication standard for home appliances will be described.

<B. Repeater 300 Configuration>

Figure 2:
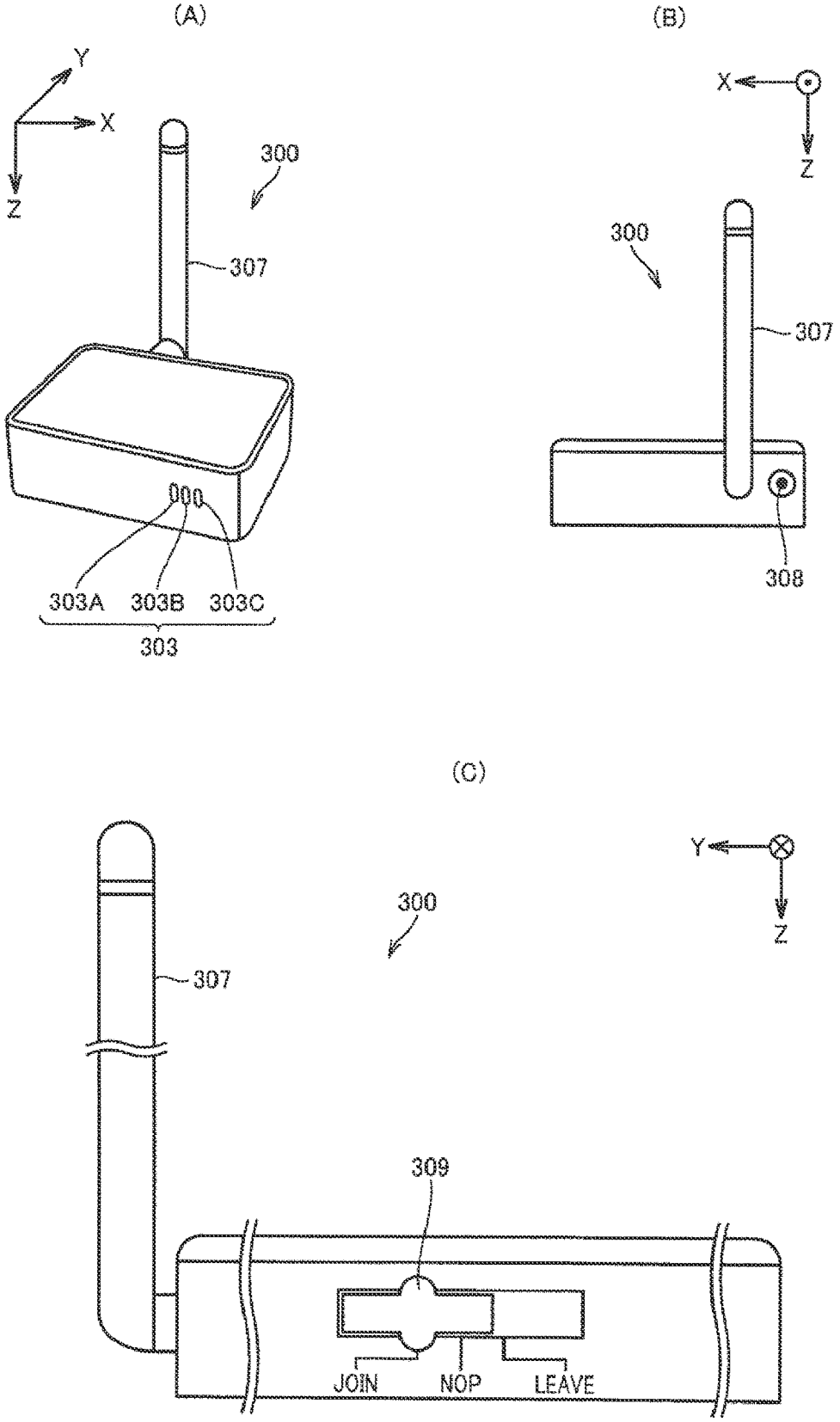
FIG. 2 is a diagram representing an outer appearance of a repeater.

FIG. 2 is a diagram representing an outer appearance of the repeater 300. FIG. 2(A) to FIG. 2(C) are included in FIG. 2. FIG. 2(A) is a perspective view of the repeater 300. FIG. 2(B) is a side surface view of the repeater 300. FIG. 2(C) is a main section enlarged view of another side surface of the repeater 300.

With reference to FIG. 2(A), the repeater 300 is provided with a light emitting section 303 and an antenna 307. The light emitting section 303 is configured by three light emitting diodes (LED) 303A, 303B, and 303C for displaying an operation state or the like of the repeater 300.

The LED 303A is a light-emitting element (power LED) for displaying the ON or OFF state of the power of the repeater 300. The LED 303B is a light-emitting element (tap LED) for displaying a communication state of the tap 600. The LED 303C is a light-emitting element (router LED) for displaying a communication state of the router 200.

The antenna 307 is used for communicating with the sensor unit 500 and the tap 600.

With reference to FIG. 2(B), the repeater 300 is further provided with a push button 308 on a surface on the opposite side to a surface on which the light emitting section 303 is provided. The push button 308 is a button for transitioning the repeater 300 to a join permitted state (join mode) or a leave mode.

With reference to FIG. 2(C), the repeater 300 is further provided with a slide switch 309 on a surface which is different to the surface on which the light emitting section 303 is provided and the surface on which the push button 308 is provided. The slide switch 309 slides by a user operation. The slide switch 309 is able to be positioned at any one of a JOIN position, a no operation (NOP) position, and a LEAVE position. Here, when the push button 308 is pressed, the slide switch 309 is used to select the join permitted state or the leave mode for the repeater 300. The slide switch 309 is set at the NOP position during normal use.

Figure 3:
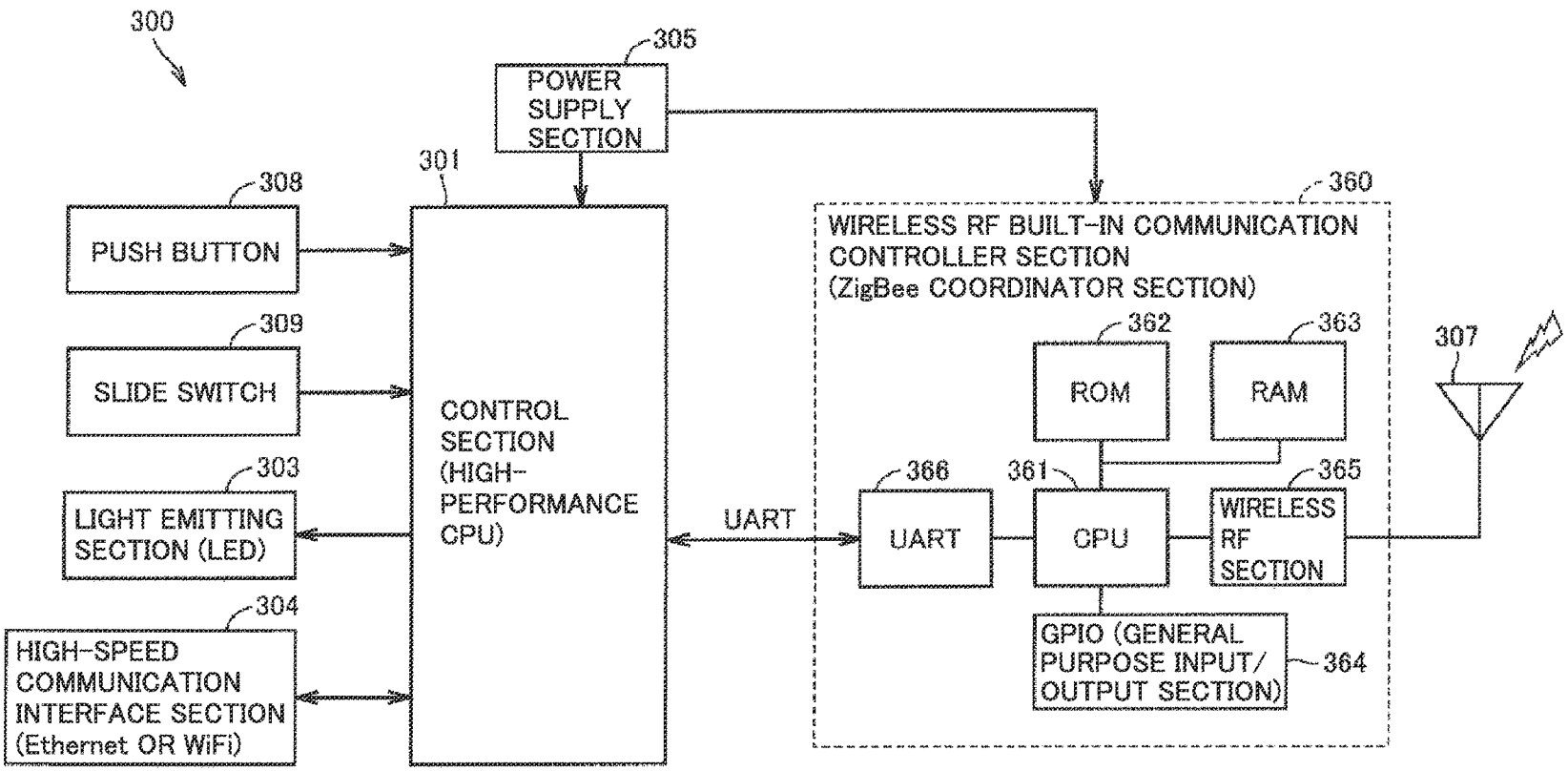
FIG. 3 is a block diagram illustrating the repeater.

FIG. 3 is a block diagram of the repeater 300. With reference to FIG. 3, the repeater 300 is provided with a control section 301, the light emitting section 303, a high-speed communication interface section 304, a power supply section 305, a wireless radio frequency (RF) built-in communication controller section 360, the antenna 307, the push button 308, the slide switch 309, and a reset switch which is not shown in the drawings.

The wireless RF built-in communication controller section 360 includes a central processing unit (CPU) 361, a read only memory (ROM) 362, a random access memory (RAM) 363, a general purpose input/output (GPIO) 364, a wireless RF section 365, and a universal asynchronous receiver transmitter (UART) 366 for communicating with the control section 301.

In the first embodiment, the wireless RF built-in communication controller section 360 is described as operating as a ZigBee coordinator. In another embodiment, the wireless RF built-in communication controller section 360 may be operated as a ZigBee router. In that case, the wireless RF built-in communication controller section 360 is set so as to be normally receivable from another communication device which is on the network Z.

In addition, the ROM 362, the RAM 363, the UART 366, the GPIO 364, and the wireless RF section 365 are respectively connected to the CPU 361.

The wireless RF built-in communication controller section 360 is connected to the antenna 307. The wireless RF built-in communication controller section 360 controls communication with the communication device which is on the network Z. Here, the ROM 362 is typically configured using an NVRAM.

The control section 301 is provided with a CPU with high-performance in comparison to the CPU 361, and is abundant in memory. The repeater 300 is able to realize advanced information processing by such configuration.

The high-speed communication interface section 304 is an interface for performing communication with the router 200 using Ethernet or WiFi. The power supply section 305 supplies power to the control section 301 and the wireless RF built-in communication controller section 360.

The control section 301 is connected to the light emitting section 303, the high-speed communication interface section 304, the power supply section 305, the wireless RF built-in communication controller section 360, the push button 308, and the slide switch 309. The control section 301 controls the overall operation of the repeater 300. The control section 301 receives input from the push button 308 and slide switch 309. In addition, the control section 301 outputs an output instruction to the light emitting section 303.

In the network system in FIG. 1, the tablet terminal 100 acquires the measurement result of the power consumption in the tap 600 via the repeater 300. Here, in the system, as a preparation in advance, a process to link the repeater 300 and the tap 600 is carried out in order to specify that the measurement result which is acquired by the repeater 300 is detected in the tap 600, that is, the result is the power consumption of the home appliance (in FIG. 1, the microwave oven 410) to which power is supplied via the tap 600. In the present specification, the process is referred to as a "pairing".

The summary of the operation for pairing by the user is described. First, the user slides the slide switch 309 from the NOP position to the JOIN position. After this, the user presses the push button 308. Thereby, the repeater 300 is in a join permitted state for a time which is set in advance (for example, sixty seconds). Here, during this time, the control section 301 causes the light emitting section 303 to emit light in a state which is set in advance. Then, in the join permitted state of the repeater 300 and by the user inserting the tap 600 into the outlet 710, "pairing" is performed between the repeater 300 and the tap 600.

<C. Tap 600 Configuration>

Figure 4:
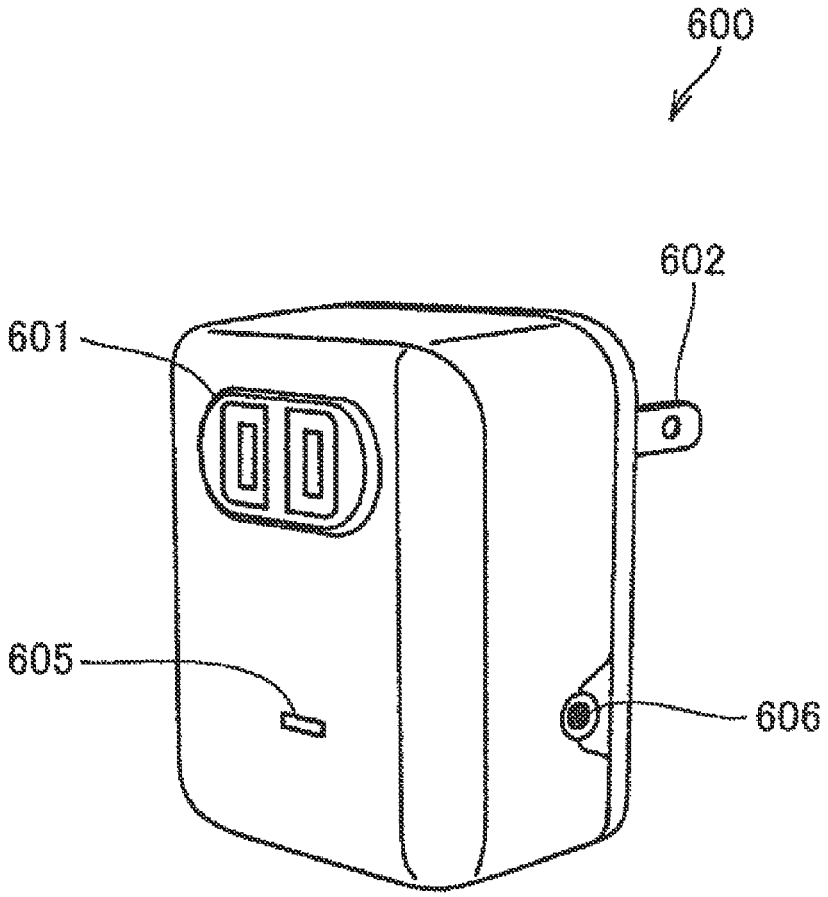
FIG. 4 is a perspective view of a tap.

FIG. 4 is a perspective view of the tap 600. With reference to FIG. 4, the tap 600 is provided with the socket 601 for inserting a plug, a plug 602, an LED 605, and a setting button 606. When using the tap, the user inserts the plug 602 into the outlet which is installed in the home while inserting the home appliance power plug into the socket 601 (refer to FIG. 1). Here, the form of the socket 601 is determined according to the form of the home appliance power plug to be connected.

Figure 5:
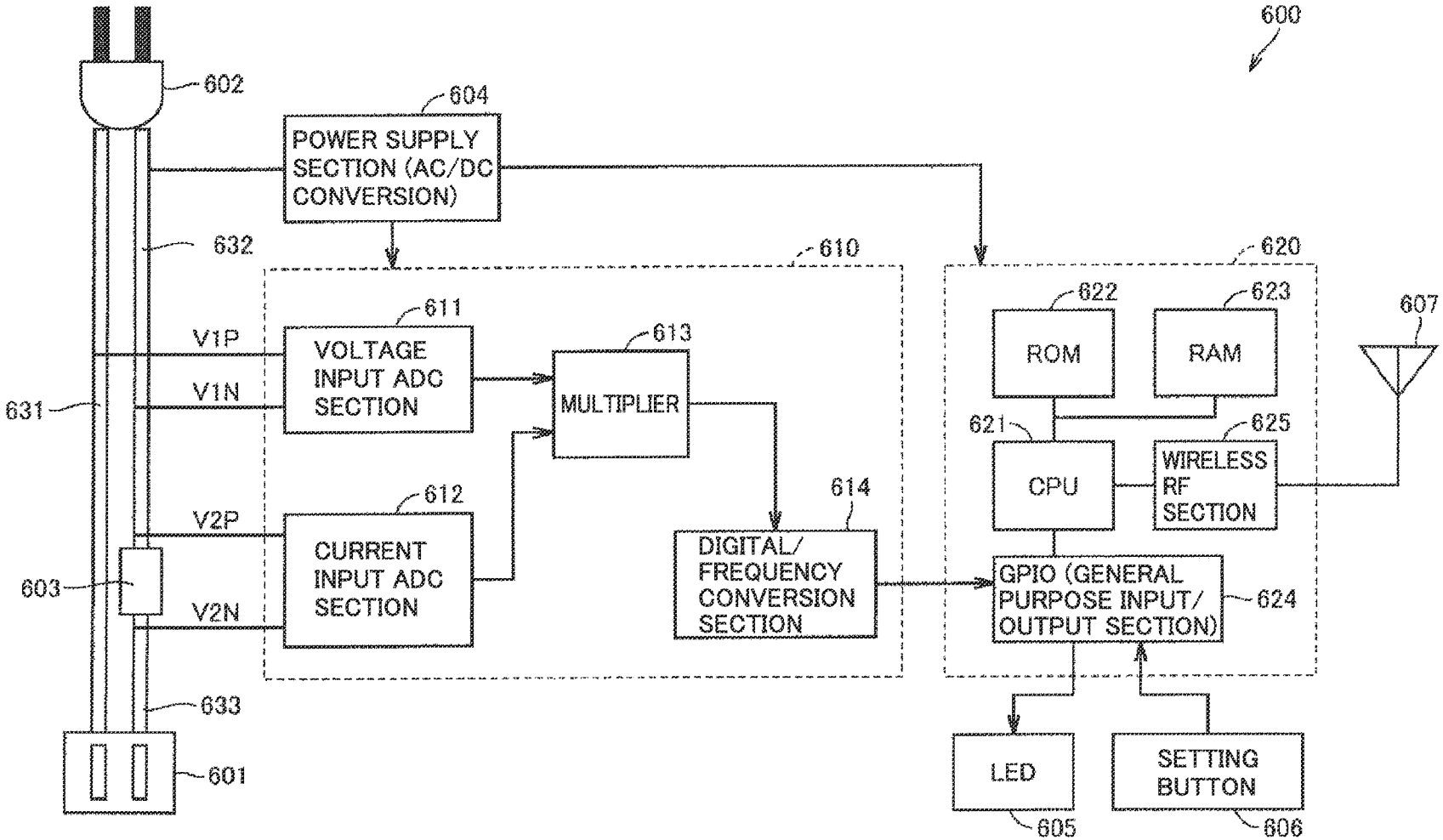
FIG. 5 is a diagram representing a hardware configuration of the tap.

FIG. 5 is a diagram representing a hardware configuration of the tap 600. With reference to FIG. 5, the tap 600 is provided with the socket 601, the plug 602, a shunt resistor 603, a power supply section 604, the LED 605, the setting button 606, the antenna 607, a power sensor section 610, a wireless RF built-in communication controller section 620, a wire 631, a wire 632, and a wire 633.

The power sensor section 610 includes a voltage input ADC section 611, a current input ADC section 612, a multiplier 613, and a digital/frequency conversion section 614. The wireless RF built-in communication controller section 620 includes a CPU 621, a ROM 622, a RAM 623, a GPIO 624, and a wireless RF section 625.

The wire 632 and the wire 633 are connected by the shunt resistor 603. The shunt resistor 603 is a minute (several hundred micro Ω) resistor which is used in order to measure the current.

The socket 601 and the plug 602 are connected by the wires 631 to 633 and the shunt resistor 603. The wire 631 is connected to one terminal of the plug 602 and one terminal of the socket 601. The wire 632 is connected to the other terminal of the plug 602 and one end section of the shunt resistor 603. The wire 633 is connected to the other terminal of the socket 601 and the other end section of the shunt resistor 603.

The power supply section 604 is connected to the wire 632. The power supply section 604 converts the alternating current to a direct current. The power supply section 604 applies the direct current power, which is obtained by conversion, to the power sensor section 610 and the wireless RF built-in communication controller section 620.

The voltage input ADC section 611 is connected to the wire 631 and the wire 632. The voltage input ADC section 611 outputs the voltage (potential difference) between the wire 631 and the wire 632 to the multiplier 613 in a digital signal.

The current input ADC section 612 is connected to the wire 632 and the wire 633. The current input ADC section 612 outputs the current value of the current, which flows to the shunt resistor 603, to the multiplier 613 in the digital signal.

The multiplier 613 multiplies the output from the voltage input ADC section 611 and the output from the current input ADC section 612, and the digital signal which is obtained by multiplying is output to the digital/frequency conversion section 614.

The digital/frequency conversion section 614 converts the input digital signal to a frequency signal. The digital/frequency conversion section 614 outputs the frequency signal, which is obtained by conversion, to the GPIO of the wireless RF built-in communication controller section 620.

The CPU 621 carries out data conversion on the frequency signal which is acquired from the GPIO. The wireless RF section 625 transmits the signal, which is obtained by data conversion, to the repeater 300 using the antenna 607.

A program or the like which is executed by the CPU 621 is stored in the ROM 622. Here, the ROM 622 is typically configured using an NVRAM.

The LED 605 represents the data process state of the tap 600 using color or the like which is caused to blink or be lit. The setting button 606 is used for initial setting or the like of the tap 600 by the user.

In the first embodiment, the wireless RF built-in communication controller section 620 is described as operating as a router.

<D. Tablet Terminal 100 Configuration>

Figure 6:
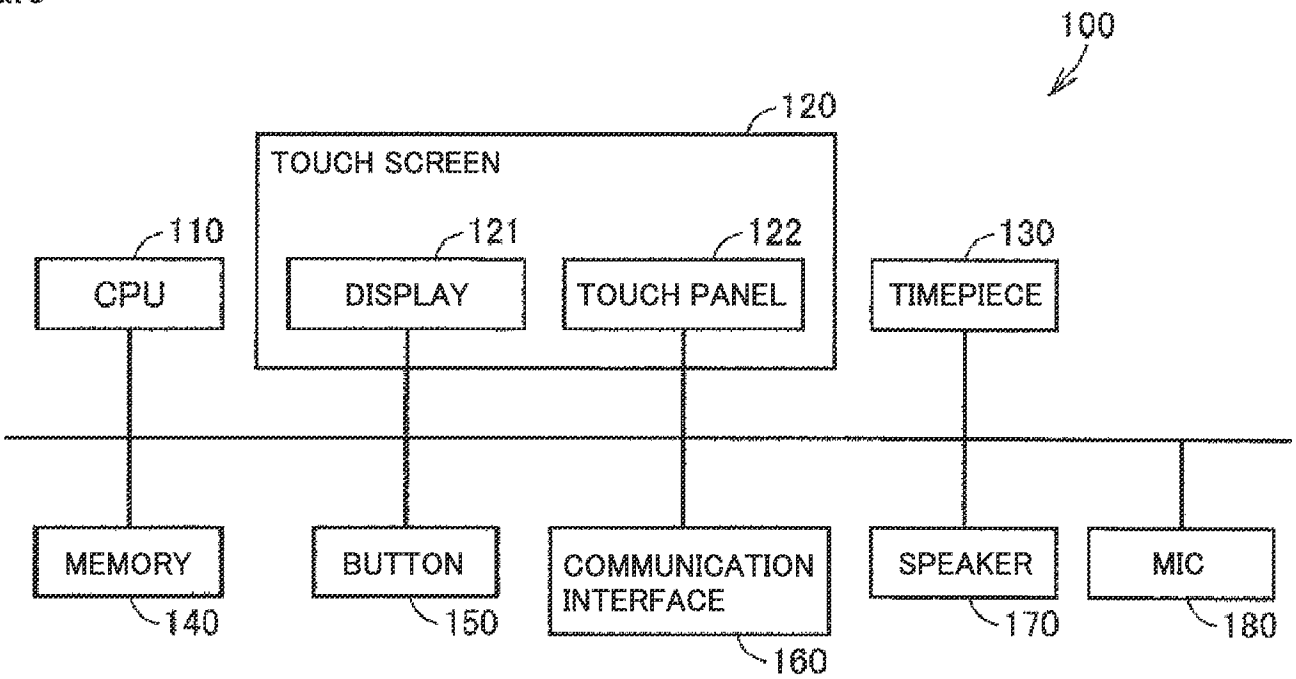
FIG. 6 is a diagram representing a hardware configuration of a tablet terminal.

FIG. 6 is a diagram representing a hardware configuration of the tablet terminal 100. With reference to FIG. 6, the tablet terminal 100 includes a CPU 110, a touch screen 120, a timepiece 130, a memory 140, a button 150, and a communication interface 160, a speaker 170, and a microphone 180 (hereinafter referred to as a "mic 180"). The touch screen 120 is configured by a display 121 and a touch panel (tablet) 122, and the touch panel 122 is laid on the surface of the display 121. However, the tablet terminal 100 may not include the touch panel 122.

The memory 140 is realized by various RAM, ROM, flash memories, hard disks, and the like. The memory 140 stores an OS and various programs which are executed by the CPU 110, and various data tables such as tables which are read by the CPU 110. For example, an application for performing setting (resetting) with respect to the tap 600 is stored in a flash memory which is a non-volatile memory in the memory 140. Here, the application performs setting of the tap 600 according to a request from the user.

The CPU 110 executes various information processing and the like by executing various programs which are stored in the memory 140. Here, the program is not only a program which is directly executable by the CPU, and includes a source program format, a compressed program, an encrypted program, and the like.

The display 121 displays, for example, power consumption of each microwave oven 410 by controlling using the CPU 110. The touch panel 122 detects a touch operation of finger of a user, and inputs touch coordinates and the like to the CPU 110. The CPU 110 receives a command from the user via the touch panel 122.

The button 150 is disposed on the surface of the tablet terminal 100. A plurality of buttons such as a decision key, a direction key, and a numeric key may be disposed on the tablet terminal 100. The button 150 receives a command from the user. The button 150 inputs the command from the user to the CPU 110.

The communication interface 160 communicates with the repeater 300 via the router 200 by controlling using the CPU 110. As described above, the communication interface 160 communicates with the router 200 using, for example, WiFi.

The speaker 170 outputs speech based on the command from the CPU 110. For example, the CPU 110 causes the speaker 170 to output speech based on speech data. The timepiece 130 inputs the current time and date to the CPU 110 based on the command from the CPU 110.

The mic 180 generates speech data based on external speech, and outputs the speech data to the CPU 110.

The CPU 110 executes various information processing and the like by executing various programs which are stored in the memory 140. In other words, the processing in the tablet terminal 100 is realized using each of hardware, and software which is executed by the CPU 110. There are cases where such software is stored in the memory 140 in advance. In addition, there are also cases where the software is stored in a storage medium and is distributed as a program product. Alternatively, there are also cases where the software is provided as a downloadable program product by a so-called Internet connected information provider.

Such software is read from the storage medium using a reading device which is not shown in the drawings, or alternatively, downloaded using the communication interface 160, and temporarily stored in the memory 140. The CPU 110 stores the software in an executable program format in the memory 140, then executes the program.

Here, as the storage medium, a medium (non-temporary medium) which stores the program in a non-volatile manner is given such as a compact disc read only memory (CD-ROM), a digital versatile disk read only memory (DVD-ROM), a universal serial bus (USB) memory, a memory card, a flexible disk (FD), a hard disk, a magnetic tape, a cassette tape, a magnetic optical disc (MO), a mini disc (MD), an integrated circuit (IC) card (except a memory card), an optical card, a mask ROM, an EPROM, and an electronically erasable programmable read-only memory (EEPROM).

<E. Server 900 Configuration>

Figure 7:
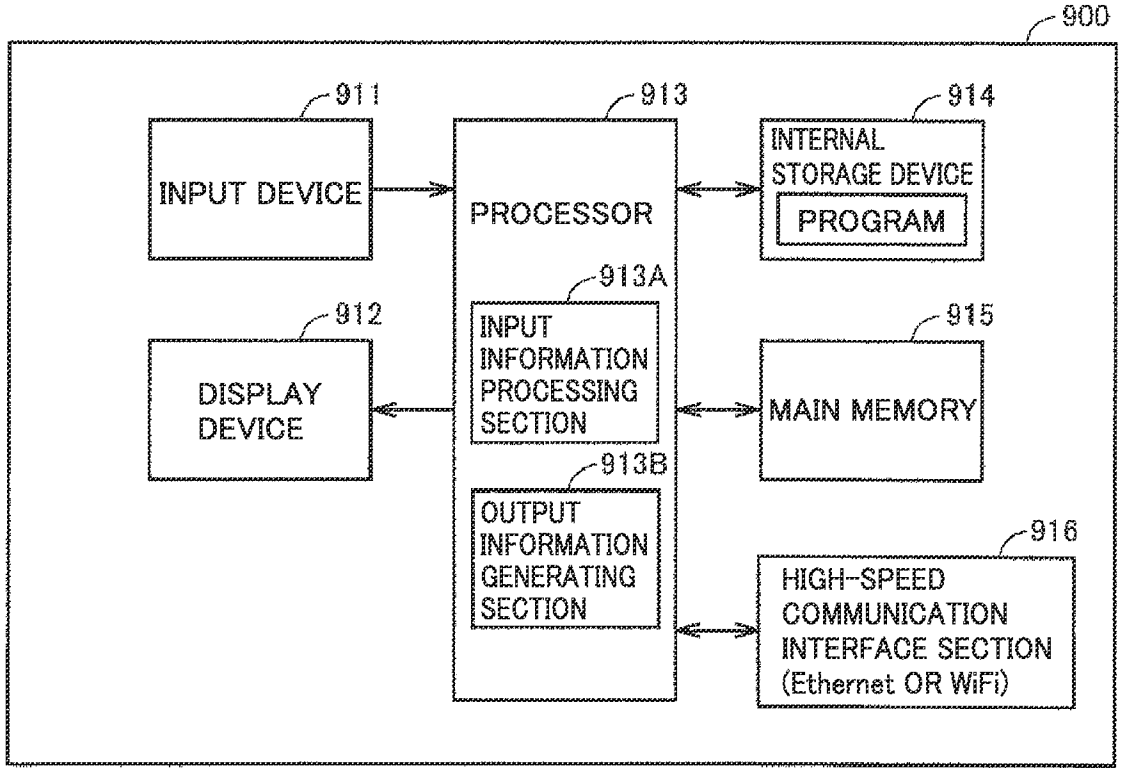
FIG. 7 is a hardware block diagram of a server.

FIG. 7 is a hardware block diagram of the server 900. As shown in FIG. 7, the server 900 includes an input device 911, a display device 912, a processor 913, an internal storage device 914, a main memory 915, and a high-speed communication interface section 916.

For example, the input device 911 is configured by a keyboard, is operated by an operator of the server 900, and outputs a signal to the processor 913 according to the user operation. The display device 912 displays an image on a screen. The displayed image is, for example, an image which indicates the operation state of server 900. The display device 912 is able to be realized by a known display device such as a liquid crystal display apparatus.

The processor 913 functions as an arithmetic processing unit by executing a computer program. In particular, the processor 913 includes an input information processing section 913A for processing information which is input from the outside, and an output information generating section 913B for generating information externally by processing the information which is input from the outside.

In the present specification, the processing which is executed by the server 900 is realized by software which is executed by each hardware and the processor 913. There are case where such software is stored in the internal storage device 914 in advance. In addition, there are also cases where the software is stored in a storage medium and is distributed as a program product. Alternatively, there are also cases where the software is provided as a downloadable program product by a so-called Internet connected information provider. Here, the program is not only a program which is directly executable by the CPU, and includes a source program format, a compressed program, an encrypted program, and the like.

A computer program which is executed by the processor 913 is stored in the internal storage device 914. The internal storage device 914 is a medium which stores the program in a non-volatile manner and non-temporarily such as, for example, a CD-ROM, a DVD-ROM, a USB memory, a memory card, an FD, a hard disk, a magnetic tape, a cassette tape, an MO, an MD, an IC card (except a memory card), an optical card, a mask ROM, an EPROM, a EEPROM.

The main memory 915 temporarily stores various data. The main memory 915 is, for example, a pseudo static random access memory (PSRAM).

The high-speed communication interface section 916 is an interface for performing communication with the router 200 using Ethernet or WiFi. The high-speed communication interface section 916 communicates with another apparatus via a network 800. Thereby, in addition to the home networks which include the network E and the network Z, the server 900 is able to communicate with home networks 810, 820, and 830 which are separate from the above home networks.

<F. Process Summary>

As described above, in the first embodiment, the tablet terminal 100 provides information that assists cooking using at least one of the microwave oven 410 and the IH cooker 420 based on the measurement result of the power consumption of at least one of the microwave oven 410 and the IH cooker 420. A summary of the process for providing the information will be described.

FIG. 8 is a diagram illustrating an example of an image of recipe information which is displayed on the tablet terminal 100. An image 1000 in FIG. 8 includes description of each of ten procedures which are included in the recipe information. In FIG. 8, description of the ten procedures is indicated by images which are given numbers "1" to "10" in combination with explanatory text. Each description includes the image which indicates the cooking conditions and the explanatory text. Here, in the recipe information, it is not necessary for the description of all procedures to include both the image and explanatory text. The description of each procedure includes at least one of the image and explanatory text.

The image 1000 includes a related information button 1001. The related information button 1001 is operated in order to output the description to each procedure. When the related information button 1001 is operated on the tablet terminal 100, a specific application (hereinafter referred to as a "cooking assistance application") is started up.

Figure 9:
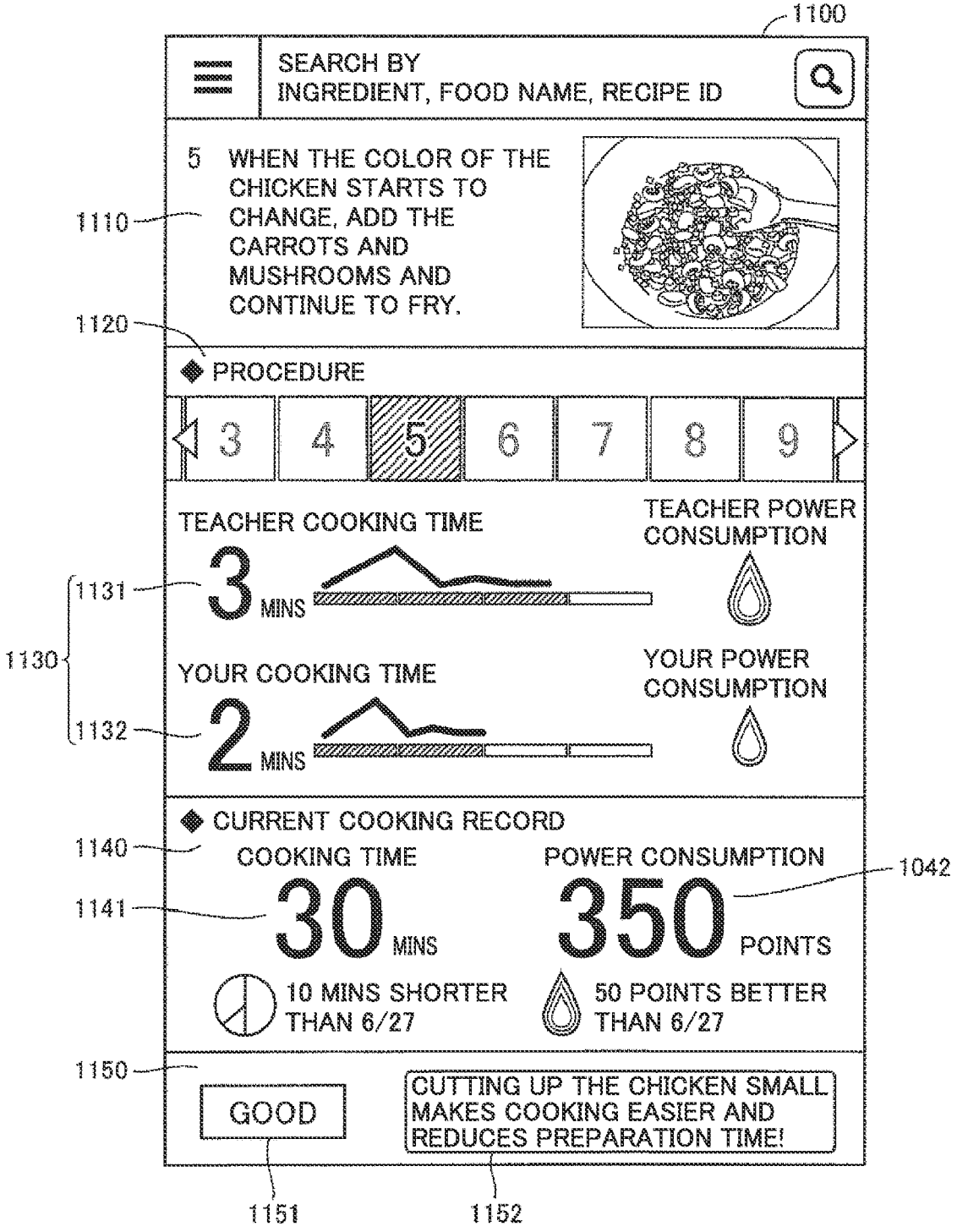
FIG. 9 is a diagram illustrating an example of an image which is displayed on the tablet terminal by a cooking assistance application.

FIG. 9 is a diagram illustrating an example of an image which is displayed on the tablet terminal 100 by the cooking assistance application. The image 1100 in FIG. 9 includes explanation 1110, procedure information 1120, power information 1130, general information 1140, and additional information 1150.

The cooking assistance application switches display on the tablet terminal 100 in each procedure in the plurality of procedures which are included in a recipe on a menu which is a display target. The explanation 1110 describes the procedure which is the display target. In FIG. 9, a fifth procedure on a cooking menu is the display target. Then, the explanation 1110 includes explanatory text and the image in order to describe the fifth procedure. In more detail, the explanation 1110 includes the explanatory text "When the color of the chicken starts to change, add the carrots and mushrooms and continue to fry.", and an image which represents cooking conditions according to the explanatory text (an image which represents a case where the chicken, carrots, and mushrooms are fried in a frying pan).

The procedure information 1120 indicates the procedure number which is the display target. In FIG. 9, in the procedure information 1120, the procedure number which is the display target is displayed in a different mode (for example, with a different display color) from the other numbers.

The power information 1130 includes reference power information 1131 and user power information 1132. The reference power information 1131 and the user power information 1132 indicate the power consumption which relates to cooking of the procedure which is the display target. In further detail, the reference power information 1131 indicates the power consumption when cooking of the procedure is carried out by a teacher who is the model for cooking. The user power information 1132 indicates power consumption in cooking by the user. Here "user" is, for example, a user who uses (logs into) the tablet terminal 100. "Power consumption in cooking by the user" is power consumption by an appliance which is determined that the user is using in cooking, and in the present embodiment, is power consumption of at least one of the microwave oven 410 and the IH cooker 420.

For example, the user starts up the cooking assistance application during actual cooking, and carries out cooking while referencing the information which is output by the application. The tablet terminal 100 acquires a value of the "power consumption in cooking by the user" in real time (for example, every four to five seconds) while outputting explanation of the procedure. Then, the tablet terminal 100 displays the information as the user power information 1132 based on the value of the acquired power consumption. Thereby, there are cases where the user power information 1132 is changed in real time.

In the example shown in FIG. 9, the reference power information 1131 includes cooking time (3 mins) and a graph which represents time change of the power consumption so as to describe "teacher cooking time". The user power information 1132 includes cooking time and a graph which represents the time change of the power consumption of the user of the tablet terminal 100 so as to describe "your cooking time". The cooking assistance application is able to extend the graph in the user power information 1132 as time passes so as to supplement the measurement result of the power consumption which is newly acquired.

The reference power information 1131 further includes an image (for example, a picture of a flame) in which the display mode is changed according to the size of the value of the power consumption so as to be displayed as "teacher power consumption". In addition, the user power information 1132 further includes an image (for example, a picture of a flame) in which the display state is changed according to the size of the power consumption so as to be displayed as "your power consumption". Since the amount of the power consumption of the reference power information 1131 is greater than the power consumption of the user power information 1132, in FIG. 9, among the two pictures of flames of the power information 1130, the picture of the flame of the reference power information 1131 is larger than the picture of the flame of the user power information 1132.

The general information 1140 includes information which represents a comparison to history of required time and power consumption in the current cooking. In more detail, the general information 1140 includes a display column 1141 and a display column 1142. The display column 1141 indicates the time from the start up of display of the explanation of the first procedure to the current display target procedure in the current cooking. The display column 1142 indicates the power consumption from the start up of display of the explanation of the first procedure to the current display target procedure. Here, the display column 1142 displays a value of power in a state in which the value is converted according to a given formula to be displayed in a given unit ("POINTS" in FIG. 9).

A comparative example of the value of past power consumption on a menu which is an output target is indicated below each of the display column 1141 and the display column 1142. The value of past power consumption is a measurement result of power consumption which is obtained during past cooking by the user of the tablet terminal 100. The user of the tablet terminal 100 is a user who logs in to the tablet terminal 100 (or the cooking assistance application).

In a case where the time until procedure 5 is reached is 30 mins in the current cooking and is 40 mins in the previous cooking, a message is displayed saying so below the display column 1141. According to FIG. 9, an example of the message is "10 mins shorter than 6/27". Furthermore, a graph for indicating a shorter time is displayed below the display column 1141.

In a case where a cumulative value of power consumption up to procedure 4 in current cooking is a reduced value corresponding to "50 POINTS" from the value corresponding to previous cooking, a message is displayed saying so below the display column 1142. According to FIG. 9, an example of the message is "50 points better than 6/27". Furthermore, a graph for indicating the size of the value of the reduced power consumption is displayed below the display column 1142.

The additional information 1150 displays information which indicates a given evaluation with respect to content of the current cooking, and includes a display column 1151 and a display column 1152. The display column 1151 represents a cooking level. It is possible to determine the cooking level, for example, using required time. For example, if the actual required time is equal to or less than the required time which is included in the data which is the model, the cooking level is determined to be "GOOD". When the actual required time exceeds the time which is the model, the cooking level "Need Improvement" is determined.

Here, cases where information other than the evaluation is displayed in the display column 1151 are possible. The tablet terminal 100 receives the input of the information which is related to the recipe information, during output of the recipe information (or at another timing). The user inputs amendments to the recipe information, matters for the user to be aware of upon cooking, and the like in the tablet terminal 100 as the information which is related to the recipe information. The CPU 110 stores the input information as a portion of, for example, common data of "user power data" (refer to FIG. 10).

Cases where such information is input in each procedure are also possible. In a case where such information is input in each procedure, the CPU 110 stores the information as a portion of each procedure of "user power data". It is possible for the information which is input in each procedure to be displayed along with content of each procedure.

The display column 1152 displays advice for improving the cooking level. The advice may be constant in each menu or regardless of the menu, and may be modified in each menu according to the cooking level.

An example is described above in which the recipe explanation is output by a mode of "display". Here, the output mode of the explanation of the recipe in the tablet terminal 100 is assumed to be: display only, speech only, a combination of both, or the like, or another output mode which is able to be considered. In addition, the explanation of all of the procedures may have the same output mode, or the output mode of the explanation in each procedure may be different.

<G. Recipe Information>

As above, the cooking assistance application outputs the explanation of each of the plurality of procedures which are included in the menu. An example of the information which is used for outputting the explanation in each procedure is described with reference to FIG. 10. FIG. 10 is a diagram illustrating a configuration example of recipe information which is utilized in the first embodiment.

With reference to FIG. 10, the recipe information includes data common to the recipe (common data), and data of each of the plurality of procedures (procedure 1, procedure 2, procedure 3, . . . ) which are included in the recipe (menu). In more detail, the recipe information includes common data and data of each procedure with respect to each of "content", "related information", "model data", and "user power data".

The "content" is data for displaying the explanation. In more detail, the "content" of the common data includes data for displaying the image 1000 in FIG. 8, and is indicated as "Data-G-1" in FIG. 10. There are cases where the "content" of the common data includes information which is displayed in the additional information 1150 in FIG. 9. The "content" of each procedure includes data for displaying the image 1100 in FIG. 9, and is indicated by "Data-A-1", "Data-A-2", and the like in FIG. 10. Here, there are cases where the "content" includes speech data.

The "related information" is information which is output in a case of being requested by the user (for example, in a case where the user performs a special operation). For example, the common data of the "related information" includes information which is related to the menu itself (for example, an episode or the like related to the menu), and is indicated by "Data-R-G" in FIG. 10. The "related information" of each procedure includes at least one of the image and speech for outputting the detailed explanation of each procedure, and is indicated by "Data-R-1", "Data-R-2", and the like in FIG. 10.

The "model data" is information on the user which is a model. In more detail, the common data of "model data" includes information which is specified by the user themself which is a model, and is indicated by "Data-TX" in FIG. 10. The "model data" of each procedure is information which specifies a value of power consumption of the cooking appliance which is used by the user when cooking of each procedure is performed, and is indicated by "Data-T-1", "Data-T-2", and the like in FIG. 10.

The "user power data" is information on the user of the tablet terminal 100. In more detail, the common data of the "user power data" includes information which is specified by the user themselves of the tablet terminal 100, and is indicated by "Data-U-G" in FIG. 10. The "user power data" of each procedure is information which specifies a value of power consumption of the cooking appliance which is used by the user when cooking of each procedure is performed, and is indicated by "Data-U-1", "Data-U-2", and the like in FIG. 10.

The "user power data" of each procedure is time which corresponds to a value of each power consumption, and includes information which specifies elapsed time after the cooking is started based on the recipe information which is exemplified in FIG. 10. The CPU 110 is able to acquire time by referencing the timepiece 130. For example, the CPU 110 stores time from a point in time at which the menu is selected to a point in time at which each value of the power consumption is measured in step S10, which will be described later with reference to FIG. 15, as the "information which specifies the elapsed time" described above.

<H. Process Flow>

In the first embodiment, as shown in FIG. 9, each menu process is displayed. Furthermore, the explanation of each procedure is displayed along with the information on power consumption in cooking by the user. In order to display in this manner, in the first embodiment, the following two processes are executed.

1) Linking of measurement device and cooking appliance

2) Display process utilizing cooking assistance application

The flow of each process will be described below.

(H-1. Linking of Measurement Device and Cooking Appliance)

In the tablet terminal 100, the measurement device and the cooking appliance are linked using an application for registering the cooking appliance (hereinafter referred to as an "appliance registration application"). The linking includes a process for linking the tap 600 and the cooking appliance, and a process for linking the sensor unit 500 and the cooking appliance.

The process for linking the tap 600 and the cooking appliance will be described. In the first embodiment, the repeater 300 and the tap 600 are linked by the "pairing" described above. The tablet terminal 100 acquires information on the tap 600 which is linked to the repeater 300 by communicating with the repeater 300 in the appliance registration application. Then, the tablet terminal 100 receives the input of information on the cooking appliance, and generates information which links the measurement device and the cooking appliance by associating the input information with the information on the tap 600. Here, the tablet terminal 100, for example, communicates with the repeater 300 via the router 200.

Figure 11:
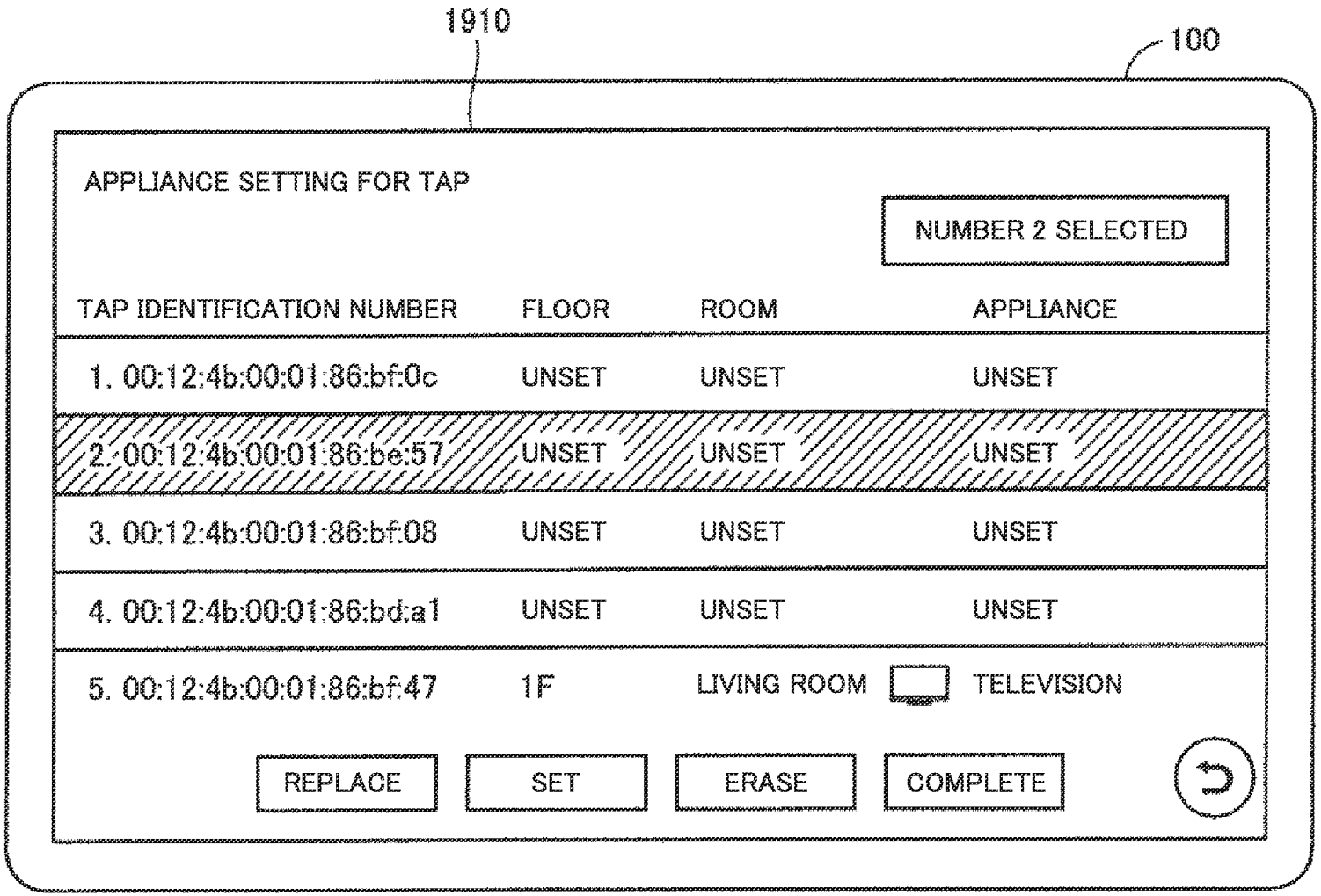
FIG. 11 is an example of an image which is displayed using an appliance registration application, and illustrates a tap which is linked to the repeater.

FIG. 11 is an example of an image which is displayed using the appliance registration application, and illustrates the tap 600 which is linked to the repeater 300. In FIG. 1, only one tap (the tap 600) is illustrated, but cases in which two or more taps are included in the cooking assistance system are possible. Information on five taps is illustrated in the image 1910 in FIG. 11.

In more detail, "tap identification number", "floor", "room", and "appliance" are indicated for each tap in the image 1910. The "tap identification number" is information which is acquired from the repeater 300. The repeater 300 acquires the identification number of the tap 600 from the tap 600 in the pairing, and transmits the identification number to the tablet terminal 100. "Floor", "room", and "appliance" are information which is input by the user. The user inputs information which indicates whether each tap is disposed on the same floor in the home as a corresponding tap "floor". In addition, the user inputs information which indicates whether each tap is disposed in the same room in the home or the like as a corresponding tap "room". In addition, the user inputs information which indicates the type of home appliance which is connected to each tap as a corresponding tap "appliance".

During the input of the information on each tap which is displayed in the image 1910, first, the user, for example, selects one tap. The information on the selected tap is displayed in a color which is different from the information on the other taps so as to be indicated in the image 1910 in FIG. 11.

Figure 12:
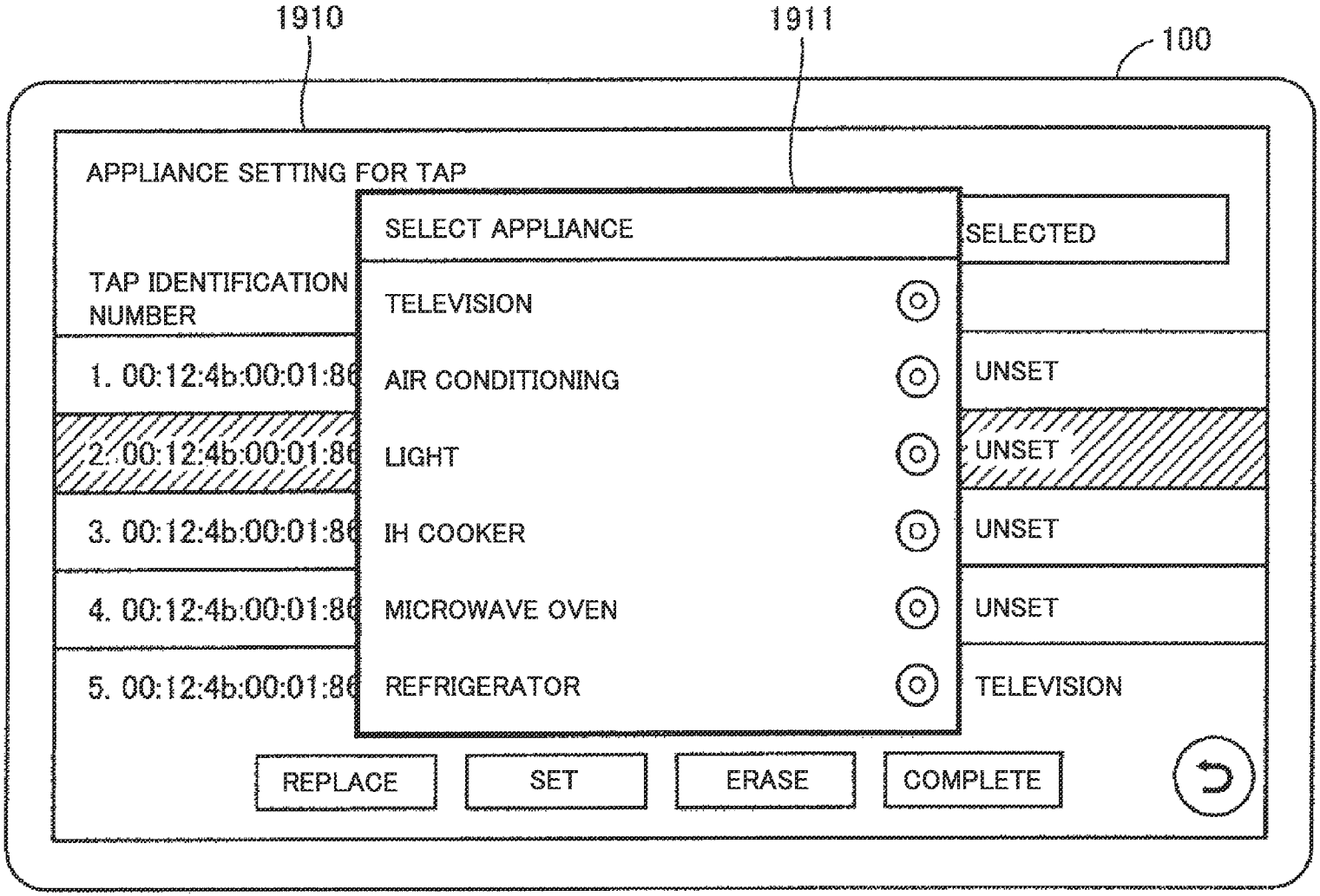
FIG. 12 is a diagram for describing selection of the type of home appliances from a list which is prepared in advance in the appliance registration application.

The type of home appliance which is connected to the tap may be directly input by the user, and may be selected from a list which is prepared in advance in the appliance registration application. FIG. 12 is a diagram for describing various selections of home appliances from the list which is prepared in advance in the appliance registration application.

As shown in FIG. 12, when an operation is performed in which the user requests display from the list, a list image 1911 is displayed on the image 1910. The list image 1911 includes a list which includes two or more types of home appliances. The user registers the information on the "appliance" which corresponds to each tap by selecting the type of home appliance from the list.

The process for linking the sensor unit 500 and the cooking appliance will be described. The tablet terminal 100 is able to communicate with the sensor unit 500 via the repeater 300. In addition, the tablet terminal 100, utilizes information which is received from the sensor unit 500, or alternatively, utilizes the information which is input from the user to store the information which specifies the sensor unit 500 in the memory 140 or the like. Furthermore, the tablet terminal 100 utilizes the information or the like which is input from the user to store the information which specifies the IH cooker 420 in the memory 140 or the like. In addition, the tablet terminal 100 stores the information which is associated with the sensor unit 500 (CT sensor 720) and the IH cooker 420. Thereby, in the tablet terminal 100, the IH cooker 420 and the CT sensor 720 which outputs the measurement result to the sensor unit 500 are linked.

(H-2. Display Process Utilizing Cooking Assistance Application)

The processes by the cooking assistance application will be described. The cooking assistance application of the first embodiment needs information which specifies the cooking appliance which is the power measurement target. In the first embodiment, the user inputs the information which specifies such a cooking appliance. For example, the information which specifies the cooking appliance is input by the operation of a selected mode being determined, in a state where the tap connected to a cooking appliance that is specified as the measurement target is selected from the image 1910 shown in FIG. 12.

Figure 13:
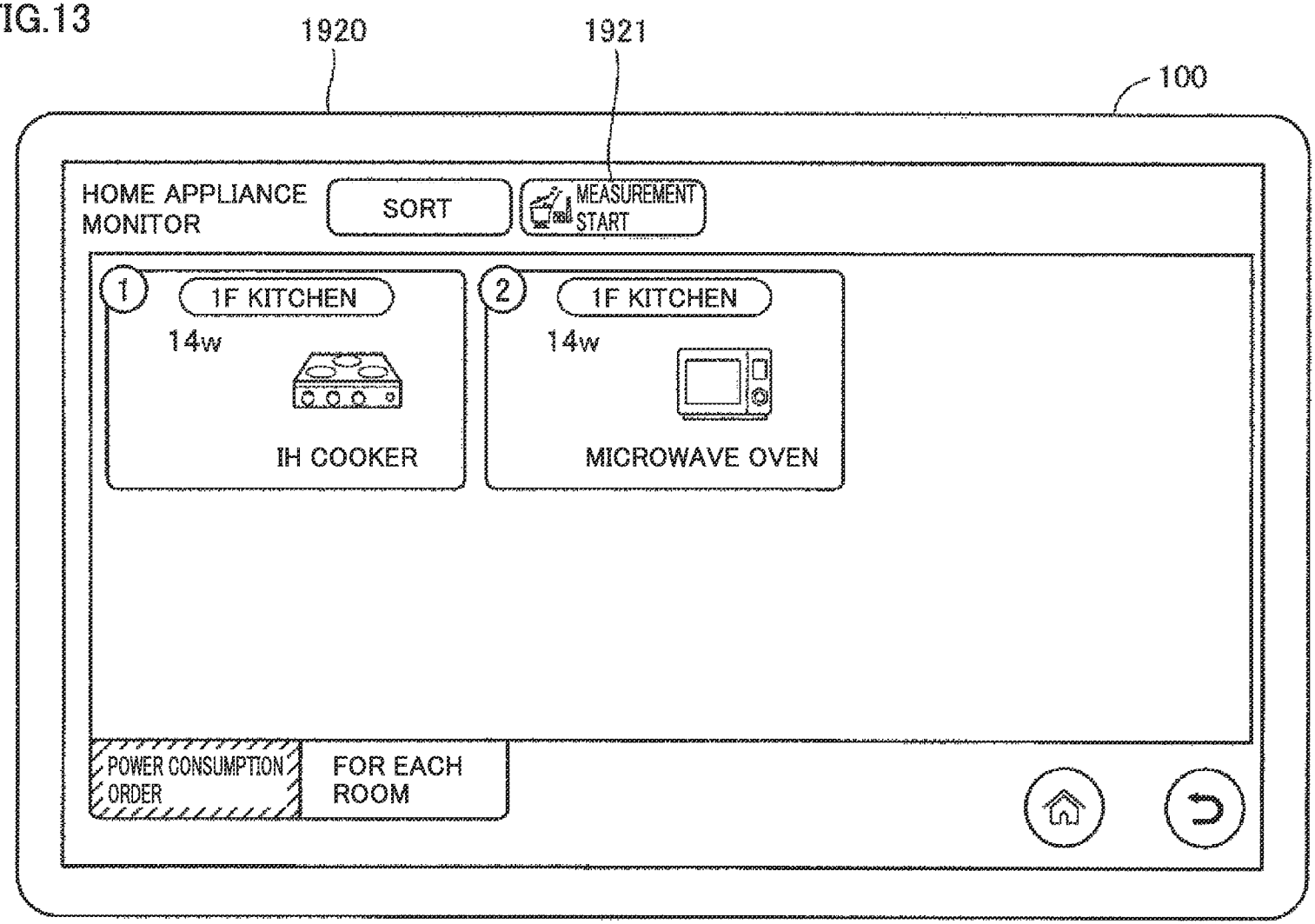
FIG. 13 is a diagram illustrating an example of an image which is displayed for inputting a start instruction of power measurement.

FIG. 13 is a diagram illustrating an example of an image which is displayed for inputting a start instruction of power measurement of the cooking appliance that is specified as the measurement target.

An image 1920 in FIG. 13 includes icons which represent the respective cooking appliances which are specified as the measurement target. In more detail, the image 1920 includes an icon which corresponds to "IH cooker" and an icon which corresponds to "microwave oven". The user operates a specific button (for example, a button 1921 in the image 1920 in FIG. 13). Thereby, during execution of the cooking assistance application, the CPU 110 of the tablet terminal 100 utilizes the power measurement result of the cooking appliance for which the icon is displayed in the image 1920.

Figure 14:
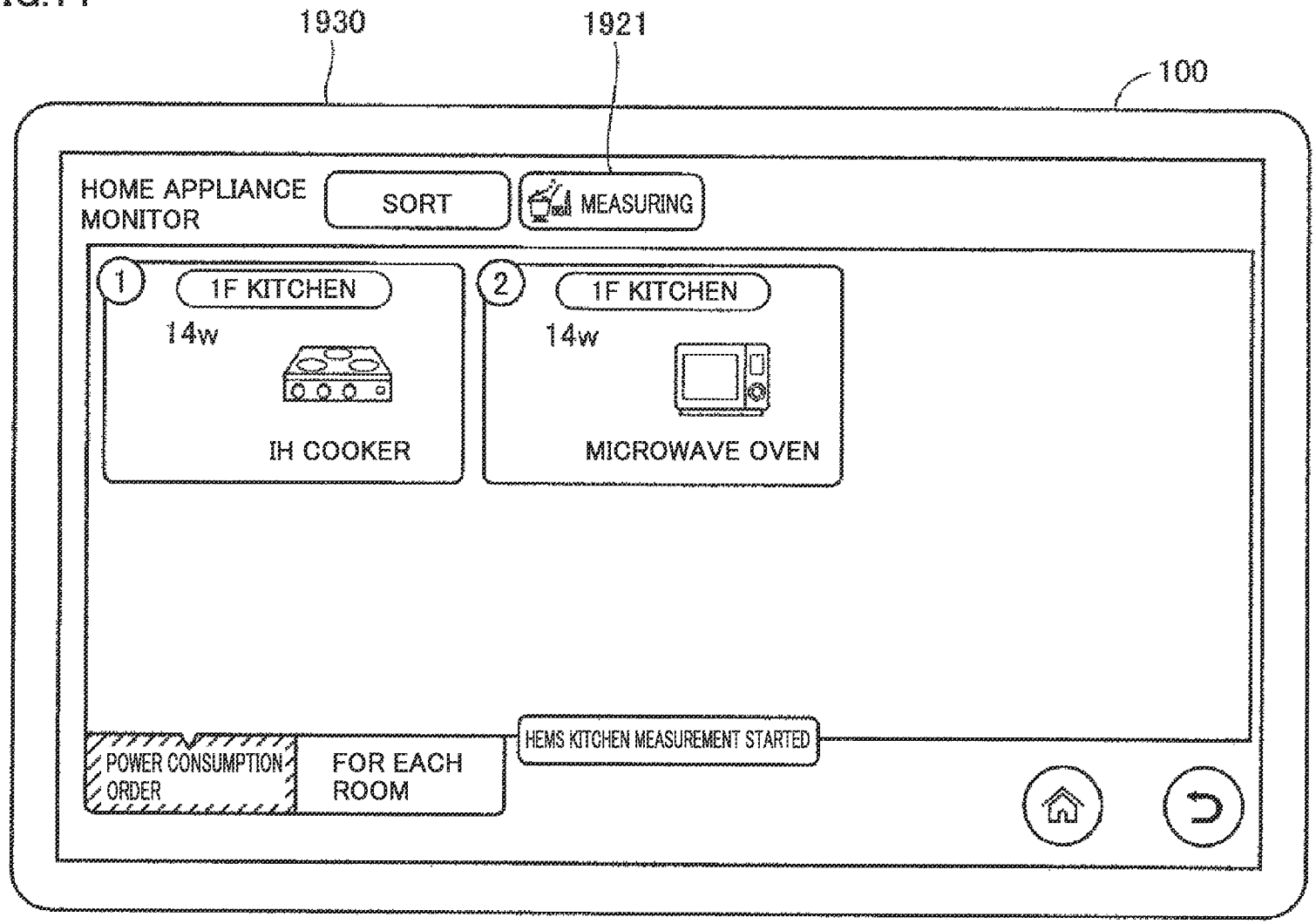
FIG. 14 is a diagram illustrating an example of an image which is displayed during measurement of power.

FIG. 14 is a diagram illustrating an example of an image which is displayed during measurement of power. An image 1930 in FIG. 14 includes an icon which corresponds to "IH cooker" and an icon which corresponds to "microwave oven" in the same manner as in the image 1920 in FIG. 13. Then, on the button 1921 in the image 1930, information which indicates that measurement of the power is taking place is displayed (for example, a character string "measuring").

As described above, a process for selecting the cooking appliance which utilizes the power measurement result and a process for starting power measurement in the cooking assistance application may be combined in the cooking assistance application, or may be configured as a separate application.

Figure 15:
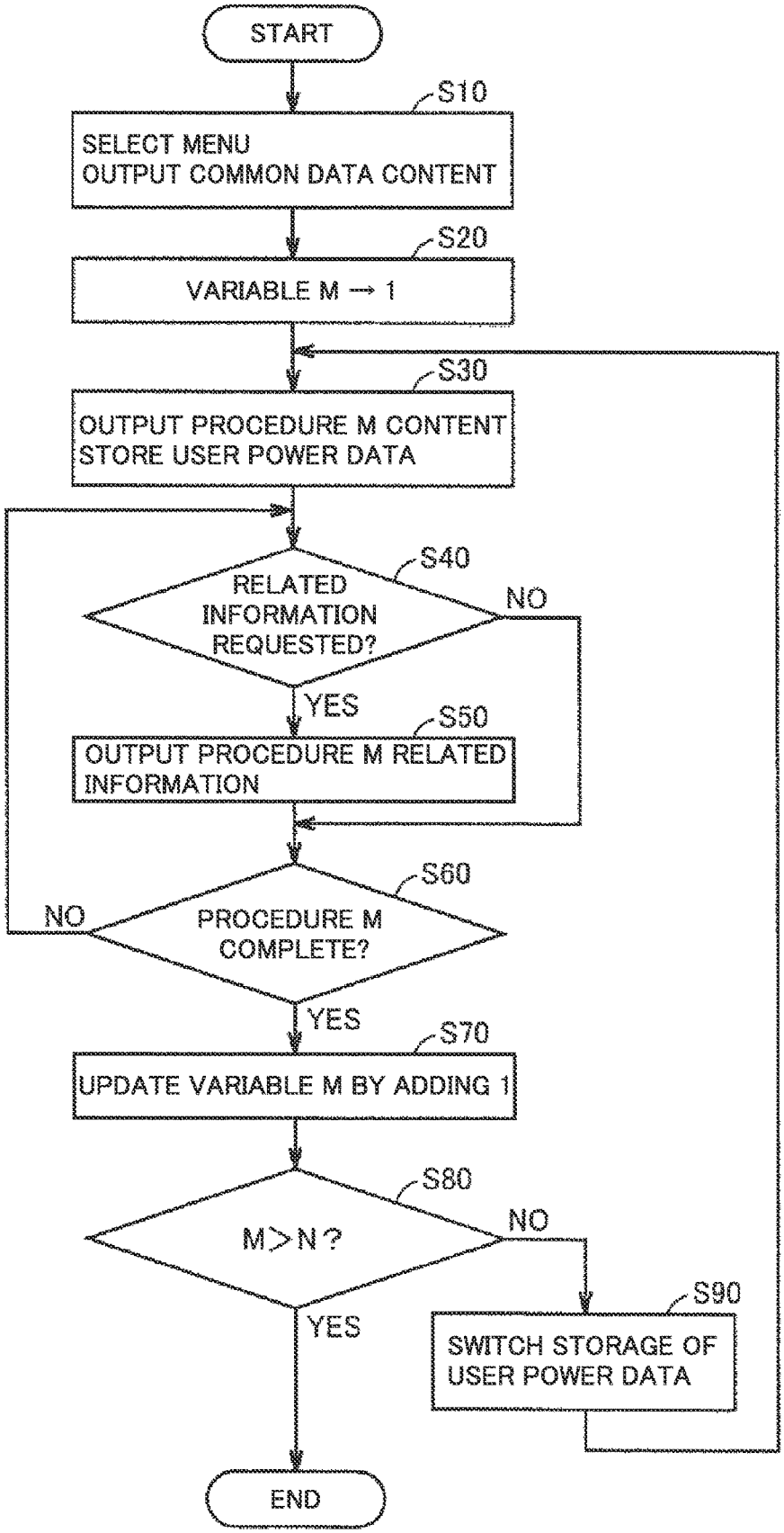
FIG. 15 is a flowchart of a process by the cooking assistance application.

FIG. 15 is a flowchart of a process by the cooking assistance application. The content of the process by the cooking assistance application will be described with reference to FIG. 15.

When the cooking assistance application is started up, in step S10, the CPU 110 of the tablet terminal 100 selects a menu which is a recipe output (display) target, and outputs the content of common data of the recipe on the menu (refer to FIG. 10). For example, the menu is selected based on the information which is input by the touch operation on the touch panel 122. Then, control proceeds to step S20.

In step S20, the CPU 110 sets the value of a variable M which is utilized in the process which is indicated in FIG. 15 to an initial value "1". Then, control proceeds to step S30.

In step S30, the CPU 110 outputs the content of an Mth procedure (refer to FIG. 10). Thereby, as shown in FIG. 9, explanation of the Mth procedure is output. At this time, the model data and user power data (refer to FIG. 10) of the Mth procedure are also output. In addition, as described with reference to FIGS. 13 and 14, as the procedure M user output data, the CPU 110 acquires the power consumption of the cooking appliance which is specified as the power measurement target and stores the power consumption in the recipe information (refer to FIG. 10). Then, control proceeds to step S40.

In step S30, the user power data is stored for each cooking appliance. In the example of the system which is shown in FIG. 1, the CPU 110 stores a value of the power consumption of the IH cooker 420 which is detected by the CT sensor 720, and a value of the power consumption of the microwave oven 410 which is detected by the tap 600 independently from each other.

The model data of the Mth procedure includes the value of the power consumption of at least one of the microwave oven 410 and the IH cooker 420 which are acquired along with the execution of step S30. Thereby, the user power data of the Mth procedure is able to, for example, be updated at every predetermined time (for example, four to five seconds). Thereby, it is also possible to update display of the user power information 1132 (refer to FIG. 9) which is displayed along with the explanation of the Mth procedure at every predetermined time in step S30.

In step S40, the CPU 110 determines whether information which requests related information is input in the tablet terminal 100. For example, in a case where a specific button is operated or specific speech (for example, a message "tell me") is input in the tablet terminal 100, the CPU 110 determines that the information in which the related information is requested is input. A known speech recognition means is mounted in the tablet terminal 100. Thereby, the CPU 110 is able to determine whether the speech which is input via the mic 180 includes a specific message. In step S40, in a case where determination is realized by detecting whether specific speech is input or not, the CPU 110 utilizes the speech recognition means.

When the CPU 110 determines that information requesting the related information is input (step S40 YES), the control proceeds to step S50. When the CPU 110 determines that information requesting the related information is not input (step S40 NO), the control proceeds to step S60.

In step S50, the CPU 110 outputs the related information of the Mth procedure (refer to FIG. 10). Then, control proceeds to step S60.

In step S60 the CPU 110 determines whether the information which represents that the Mth procedure is complete is input. For example, the input may be speech such as "end", or may be operation of a button on the tablet terminal 100. In addition, in the tablet terminal 100, in a case where a device for detecting gestures of a user, such as a camera or the like, the CPU 110 determines that the input is made by the user performing a specific gesture. When the CPU 110 determines that the input is made (step S60 YES), the control proceeds to step S70. Meanwhile, when the CPU 110 determines that the input is not made (step S60 NO), the control returns to step S40.

Here, the completion of the Mth procedure may be specified based on 1) the elapsing of a specific time from the start of the output of content which corresponds to the Mth procedure, 2) the elapsing of a specific time from a point in time at which output of content of the menu is started in step S10, 3) power of a specific amount from the start of output of content which corresponds to the Mth procedure being consumed, 4) a specific power pattern from the start of output of content which corresponds to the Mth procedure being completed, 5) power of a specific amount from the point in time at which output of content of the menu is started in step S10 being consumed, or 6) a specific power pattern being completed from the point in time at which output of content of the menu is started in step S10.

In step S70, the CPU 110 updates the variable M by adding one. Then, control proceeds to step S80.

In step S80, the CPU 110 determines whether the value of the variable M which is updated in step S70 exceeds a procedure number N which is included in the menu of the process target. Then, when the CPU 110 determines that the variable M exceeds the number N (step S80 YES), control ends. Meanwhile, when the CPU 110 determines that the variable M is less than or equal to the number N, control proceeds to step S90.

In step S90, along with update to the variable M by adding in step S70, setting is switched appropriately so as to update the target procedure in which the power consumption of the cooking appliance specified as the power measurement target is stored. Then, control returns to step S30. Thereby, for example, in a case where the value of the variable M in step S70 is switched from 4 to 5, in step S90, the information which specifies a storage target of the power consumption is switched from "procedure 4" to "procedure 5".

<I. Summary of the First Embodiment>

In the first embodiment described above, the tablet terminal 100 is able to start up the cooking assistance application during cooking by the user. Thereby, the user is able to refer to the explanation in each procedure in the selected cooking menu.

In addition, concerning the respective two or more procedures which are included in the cooking menu, the tablet terminal 100 is able to output the progress of the power consumption of the cooking appliance in cooking (at least one of the microwave oven 410 and the IH cooker 420), and also the progress of the power consumption of the cooking appliance by the user who is the model (FIG. 9 and the like). Furthermore, in the respective two or more procedures, the tablet terminal 100 is able to output information based on a result of a comparison between the measurement result of the power consumption and power consumption by the user who is a model (the size of the picture of a flame in FIG. 9 and the like). Accordingly, the user compares the value of heat intensity or the timing of the change of intensity in each procedure to the value of intensity or the timing of the change of intensity by the user who is the model. Thereby, in more detail, the user is able to confirm their own cooking skill.

After cooking has ended, the user is able to start up the cooking assistance application. Thereby, after cooking has ended, it is possible to confirm the cooking skill degree and improvement of the user by confirming the flow of power consumption of the cooking appliance in cooking by the user in each procedure. Furthermore, since it is possible to confirm information which relates to cooking by the user and information which relates to cooking by the user who is the model, it is possible to more effectively confirm the skill degree and improvement.

Second Embodiment

A second embodiment will be described below focusing on differences from the other embodiments in the present specification. When not otherwise specified, it is possible to adopt a configuration which is common with the other embodiments as the configuration of the second embodiment.

In the second embodiment, it is possible to store power data of cooking two times or more in the recipe information in the same menu of the same user. Thereby, it is possible for the cooking assistance application to output the information of power consumption in cooking of a plurality of times for the user. Thereby, the user is able to confirm the condition and degree of improvement in cooking skill.

Third Embodiment

A third embodiment will be described below focusing on differences from the other embodiments in the present specification. When not otherwise specified, it is possible to adopt a configuration which is common with the other embodiments as the configuration of the third embodiment.

The recipe information which is described with reference to FIG. 10 may at least be associated with each procedure of the menu, and include the model data and user power data. That is, the content of each of the procedures may be stored in another device such as the server 900.

The tablet terminal 100 is able to communicate with the other device. In the third embodiment, the data "content" in the recipe information (FIG. 10) is information which specifies the storage location and the content file of the respective content. By communicating with the other device, the CPU 110 of the tablet terminal 100 is provided with information such as described with reference to FIG. 9 by acquiring the file which is specified by the data "content" from the storage location which is specified by the data "content".

Fourth Embodiment

A fourth embodiment will be described below focusing on differences from the other embodiments in the present specification. When not otherwise specified, it is possible to adopt a configuration which is common with the other embodiments as the configuration of the fourth embodiment.

Figure 16:
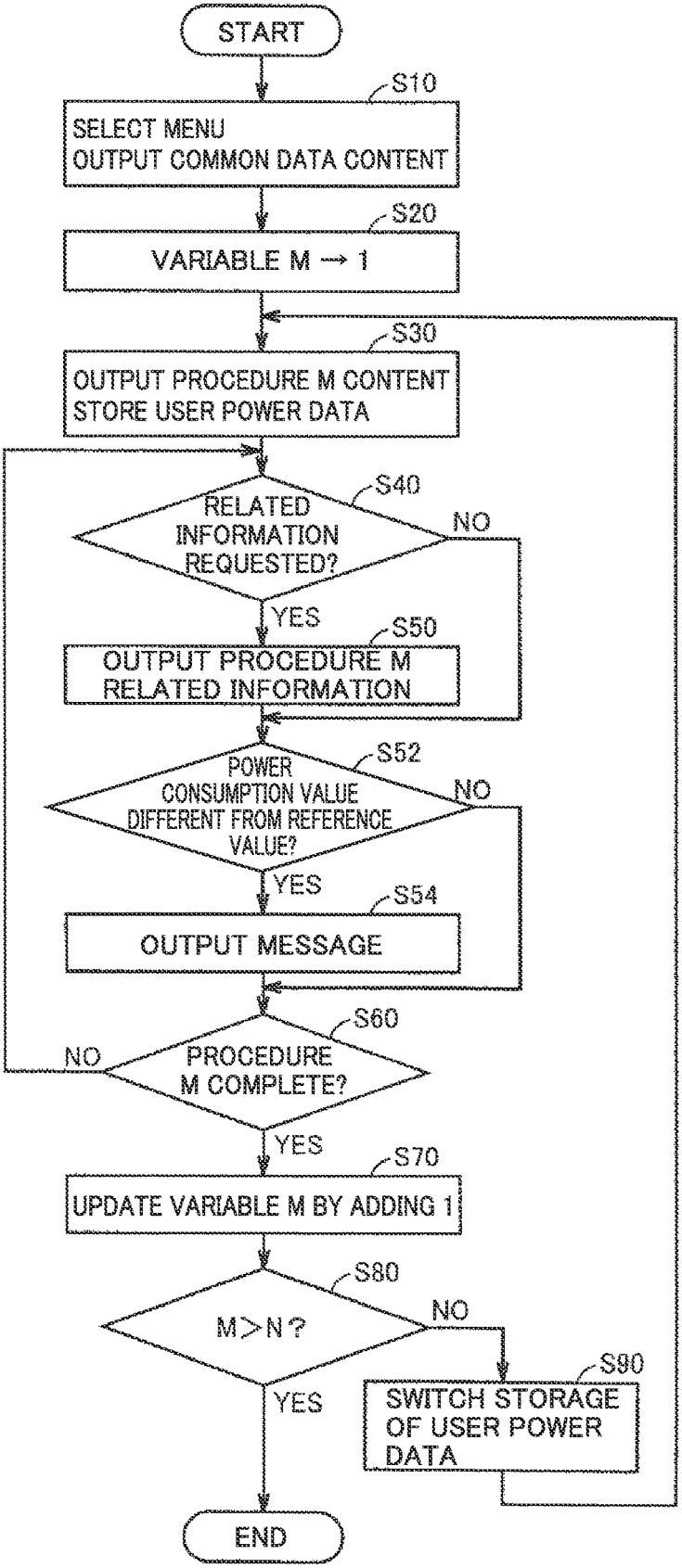
FIG. 16 is a flowchart of a process by the cooking assistance application of a fourth embodiment.

In the fourth embodiment, based on the model data, not only the information with respect to the power consumption, but also, or in place of the information on the power consumption, advice is sequentially provided to the user who is the target for providing information by the tablet terminal 100 (hereinafter referred to as "target user"). FIG. 16 is a flowchart of a process of the cooking assistance application of the fourth embodiment. For example, the target user is a user who logs in to the tablet terminal 100 or the cooking assistance application.

In the process which is shown in FIG. 16, control in step S52 and step S54 is added to the process which is shown in FIG. 15. Here, mainly, the differences from the process which is shown in FIG. 15 are described.

With reference to FIG. 16, after the related information in procedure M is output in step S50, or after it is determined that there is no request for the related information in step S40, in step S52, the CPU 110 compares the latest user power data to the value (reference value) of power of the model data (refer to FIG. 10) which corresponds to the user power data. Then, when the CPU 110 determines that the values are different (step S52 YES), the control proceeds to step S54. Meanwhile, when the CPU 110 determines that the values match (step S52 NO), the control proceeds to step S60.

The model data which corresponds to the user power data has a power value which is stored as data with the same elapsed time of the same procedure as the user power data which is the process target among the model data. In more detail, in a case where user power data of the process target is a measurement result one minute from the start of procedure 2 in procedure 2, the model data which is stored as the measurement result one minute from the start of procedure 2 in procedure 2 in the recipe information is "corresponding model data".

In step S54, the CPU 110 outputs a message which corresponds to the result of the comparison between the user power data and the corresponding model data. Then, control proceeds to step S60.

The process content in step S54 will be described in more detail. For example, in a case where the power value of the user power data is greater than the power value of the corresponding model data, the CPU 110 outputs the message for conveying such. The output message is, for example, "Heating power is stronger than the model data. Check the heating power". In addition, the CPU 110 may output a message which promotes suppression of the power consumption. The output message is, for example, "Heating power is stronger than the model data. Reduce the heating power".

For example, in a case where the power value of the user power data is smaller than the power value of the corresponding model data, the CPU 110 outputs the message for conveying such. The output message is, for example, "Heating power is weaker than the model data. Check the heating power". In addition, the CPU 110 may output a message which promotes increasing the power consumption. The output message is, for example, "Heating power is weaker than the model data. Increase the heating power".

Here, the output message may be modified according to the type of cooking appliance. The message is output in a case where, for example, the type of cooking appliance is the "IH cooker". In a case where the type of the cooking appliance is the "microwave oven", for example, "heating power" is modified to "output".

Fifth Embodiment

A fifth embodiment will be described below focusing on differences from the other embodiments in the present specification. When not otherwise specified, it is possible to adopt a configuration which is common with the other embodiments as the configuration of the fifth embodiment.

It is possible to store the power data of a plurality of users other than the target user in the recipe information. In the fifth embodiment, the power data of each procedure in the same menu is accumulated in the tablet terminal 100 via the network 800. Then, the accumulated data is stored in the recipe information of the tablet terminal 100.

FIG. 17 is a diagram illustrating an example of recipe information which is generated in the fifth embodiment. As indicated by "user A power data" in FIG. 17, the recipe information includes a value of power consumption of each procedure of another user other than model data and data of power consumption of the target user. The cooking assistance application may generate the information in FIG. 17 by acquiring the user data of each network each time the cooking assistance application is executed in each of the plurality of home networks, and may generate the information in FIG. 17 by utilizing the information which is registered on the server 900 or the like, or by utilizing the input information in which there is no relationship with the execution of the cooking assistance application with respect to the tablet terminal 100 or the server 900.

In the fifth embodiment, since the recipe information includes the value of the power consumption of a plurality of different users, it is possible to output an average value of the power consumption of the plurality of different users in place of information on power consumption of the model in each procedure ("reference power information 1131" in FIG. 9).

Figure 18:
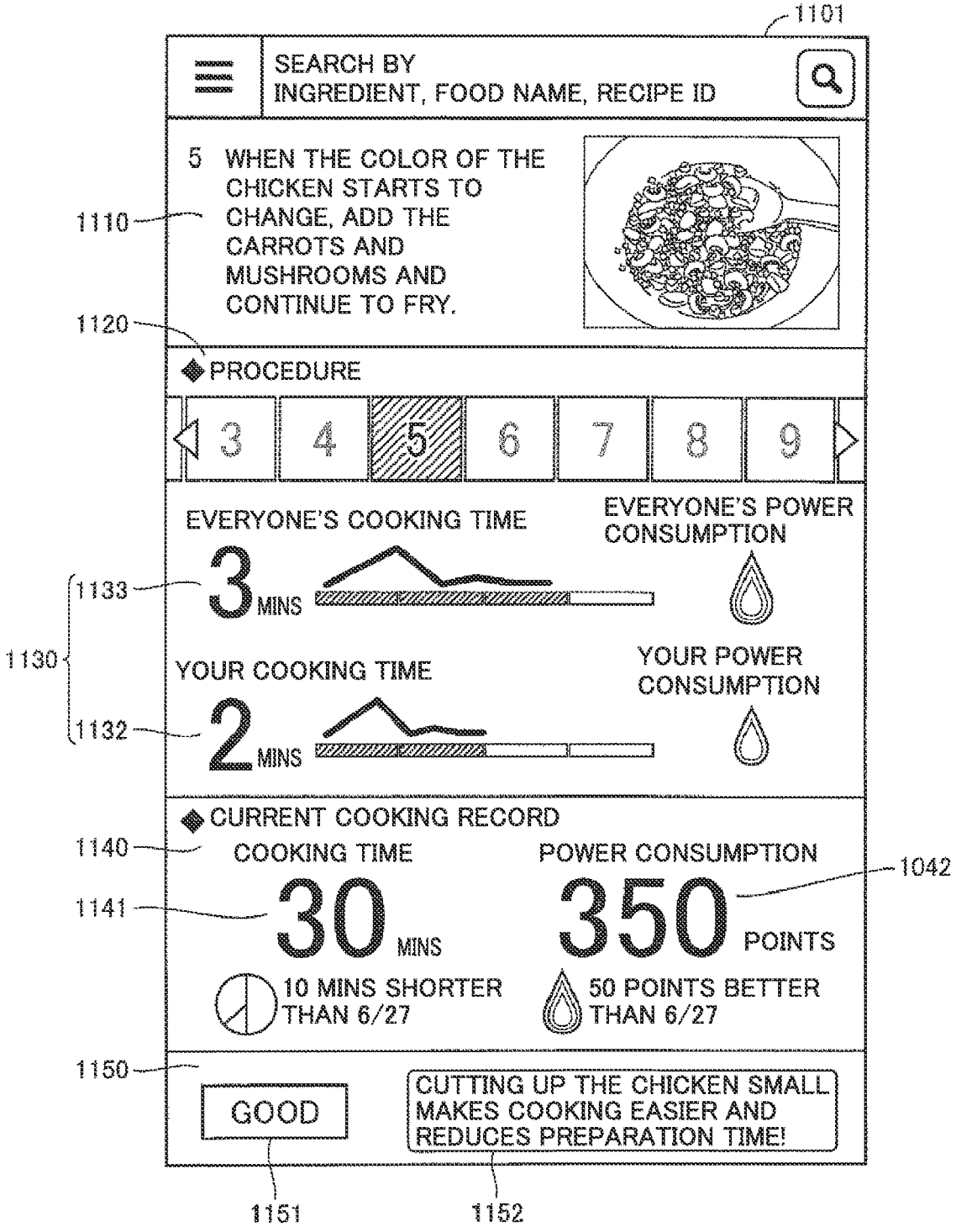
FIG. 18 is a diagram illustrating a modification example of an image which is displayed by the cooking assistance application.

FIG. 18 is a diagram illustrating a modification example of an image which is displayed by the cooking assistance application. In the image 1101 in FIG. 18, the power information 1130 includes average power information 1133 and the user power information 1132. The cooking assistance application displays the average value of power consumption of two or more users in the recipe information of the procedure which is the display target as the average power information 1133.

Sixth Embodiment

A sixth embodiment will be described below focusing on differences from the other embodiments in the present specification. When not otherwise specified, it is possible to adopt a configuration which is common with the other embodiments as the configuration of the sixth embodiment.

In the sixth embodiment, it is possible to compare the information between users by utilizing the measurement result of power consumption of the plurality of users such as described in the fifth embodiment. As the information to be compared, for example, it is possible to give a mode of the time change of the power consumption and a total amount of power consumption which is consumed for cooking. Such comparison is executed by the user selecting a special menu (hereinafter referred to as "cooking method comparison menu"). The user normally selects the cooking method comparison menu when, for example, a schedule is made for a cooking method and the like other than during cooking.

Figure 19:
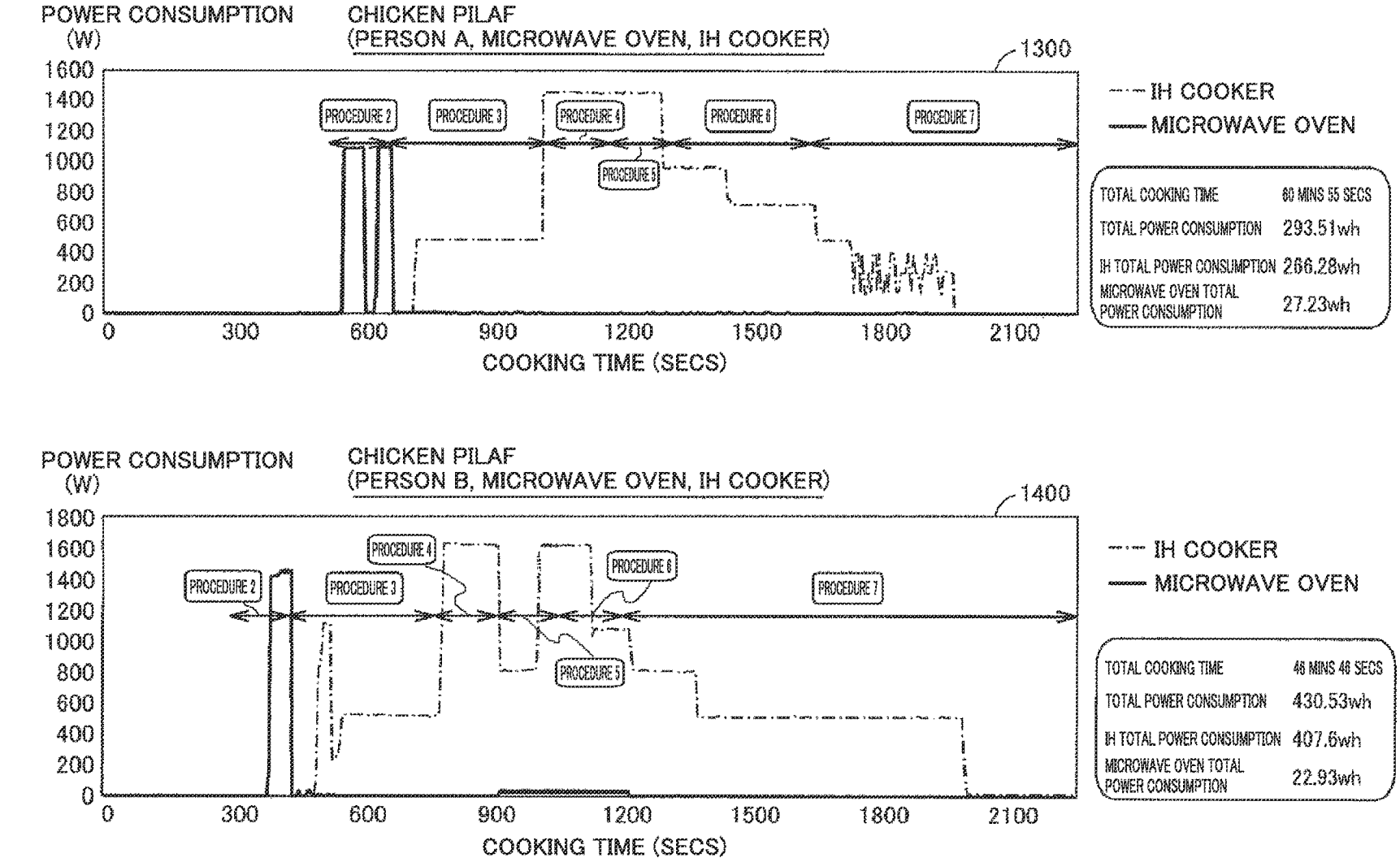
FIG. 19 is a diagram illustrating an example of an image which is displayed by the cooking assistance application on a cooking method comparison menu.
Figure 20:
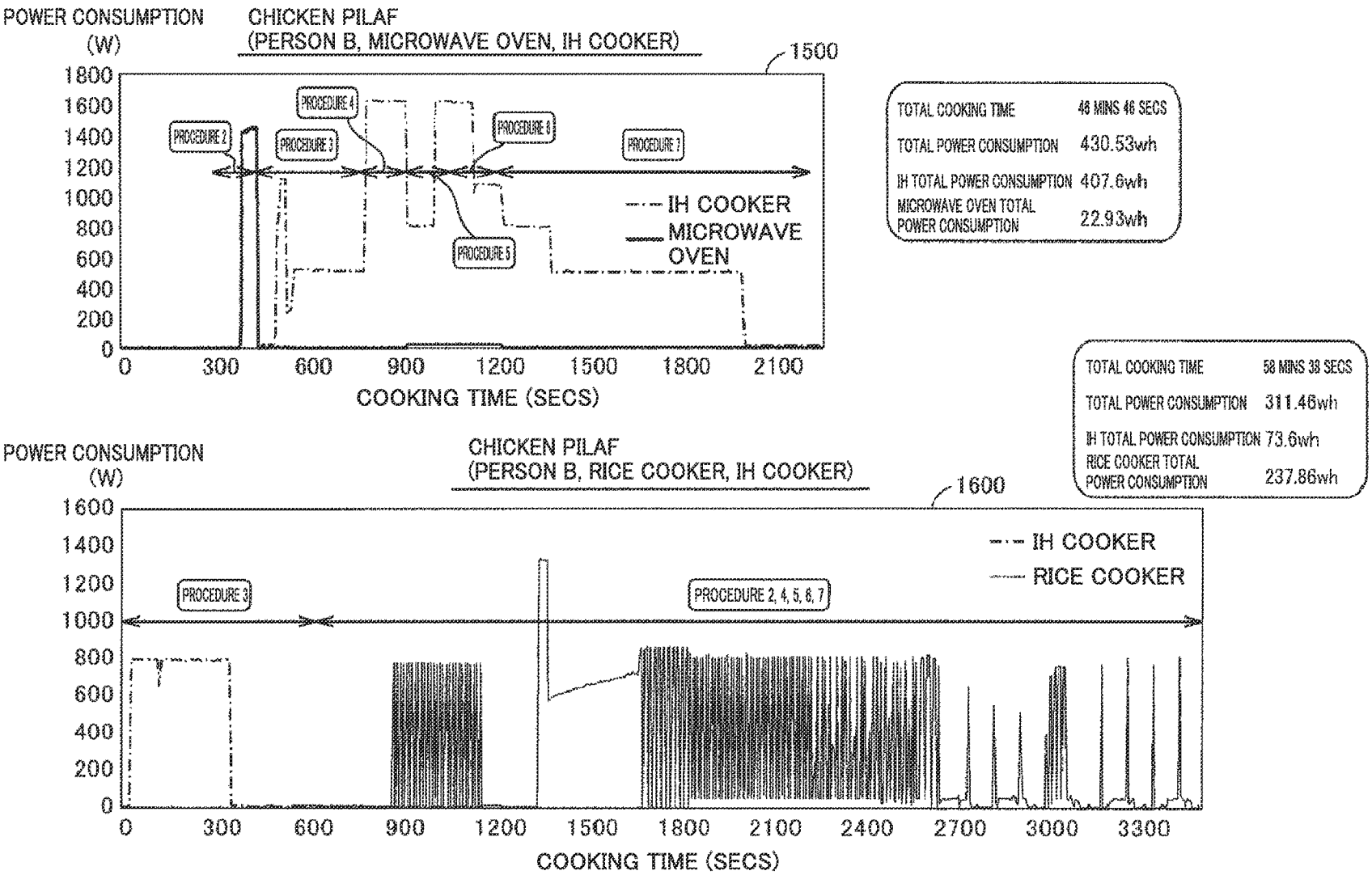
FIG. 20 is a diagram illustrating another example of an image which is displayed by the cooking assistance application on a cooking method comparison menu.

FIG. 19 is a diagram illustrating an example of an image which is displayed by the cooking assistance application on the cooking method comparison menu. FIG. 20 is a diagram illustrating another example of an image which is displayed by the cooking assistance application on the cooking method comparison menu.

FIG. 19 includes a graph 1300 and a graph 1400. The graph 1300 indicates the time change of the power consumption in the cooking by the user A on the cooking menu "chicken pilaf". The graph 1400 indicates the time change of the power consumption in the cooking by the user B on the cooking menu "chicken pilaf" which is the same as when the graph 1300 is the target. Both of the graph 1300 and the graph 1400 include the time change of the power consumption of the IH cooker and the time change of the power consumption of the microwave oven.

In both of the graph 1300 and the graph 1400, the range which corresponds to each of the "procedure 2" to "procedure 7" is indicated by six bidirectional arrows. In addition, in both of the graph 1300 and the graph 1400, in cooking, the consumed power amount which corresponds to each procedure is indicated. For example, "consumed power amount which corresponds to the procedure" has the meaning of the sum of power which is consumed during a period in which the explanation of the corresponding procedure is output by the cooking assistance application.

Furthermore, the graph 1300 and the graph 1400 indicate the total amount of cooking time, the total amount of power consumption, and the total amount of power consumption of each of the IH cooker and the microwave oven within the total amount. In more detail, in the cooking which is illustrated in graph 1300, the total amount of cooking time is "60 mins and 55 secs", the total amount of power consumption is "293.51 wh", the total amount of the power consumption of the IH cooker is "266.28 wh", and the total amount of the power consumption of the microwave oven is "7.23 wh". In addition, in the cooking which is illustrated in graph 1400, the total amount of cooking time is "46 mins and 46 secs", the total amount of power consumption is "430.53 wh", the total amount of the power consumption of the IH cooker is "407.6 wh", and the total amount of the power consumption of the microwave oven is "22.93 wh".

As understood from FIG. 19, in the cooking according to graph 1300, in comparison to the cooking according to graph 1400, the cooking time is long, but the power consumption is lowered. Accordingly, in a case where the user desires to suppress the amount of power consumption even if the cooking time is long, cooking is performed using the pattern according to the graph 1300. Meanwhile, in a case where it is desired to suppress the cooking time to be short even if the power consumption is slightly high, cooking is performed using the pattern according to the graph 1400.

That is, the user is able to perform cooking by selecting the cooking pattern which is specialized in the matter in which the user prioritizes by confirming the plurality of measurement results of the power consumption in the cooking menu which is the same as shown in FIG. 19.

FIG. 20 includes a graph 1500 and a graph 1600. The graph 1500 indicates the time change of the power consumption in the cooking using the IH cooker and the microwave oven on the cooking menu "chicken pilaf". The graph 1600 indicates the time change of the power consumption in the cooking using the IH cooker and a rice cooker on the cooking menu "chicken pilaf" which is the same as when the graph 1500 is the target. The graph 1500 and the graph 1600 indicate the time change of the measured power consumption in the cooking by the user B. Here, in the graph 1500, the time change of the power consumption is indicated which is the same as indicated in graph 1400 in FIG. 19.

In the cooking assistance system which is described in FIG. 1, it is also possible to adopt a rice cooker as the cooking appliance which is the measurement target of the power consumption. It is also possible in the rice cooker to measure the power consumption using the measurement device of the tap 600, the CT sensor 720, and the like.

In the graph 1600, the order of the procedures is different from the order which is indicated in graph 1500 and the like. In the cooking assistance application, it is possible to store the information on the power consumption which corresponds to each procedure even in a case where the explanation of each procedure in the recipe information is output in an order which is different from the order which is specified in the recipe information.

Furthermore, the graph 1500 and the graph 1600 indicate the total amount of cooking time, the total amount of power consumption, and the total amount of power consumption of each of the IH cooker and the microwave oven (or the rice cooker) within the total amount. In more detail, in the cooking which is illustrated in graph 1500, the total amount of cooking time is "46 mins and 46 secs", the total amount of power consumption is "430.53 wh", the total amount of the power consumption of the IH cooker is "407.6 wh", and the total amount of the power consumption of the microwave oven is "22.93 wh" in the same manner as the cooking which is indicated by graph 1400. In the cooking which is illustrated in graph 1600, the total amount of cooking time is "58 mins and 38 secs", the total amount of power consumption is "237.86 wh", the total amount of the power consumption of the IH cooker is "73.6 wh", and the total amount of the power consumption of the rice cooker is "237.86 wh".

As understood from FIG. 20, in the cooking according to graph 1600, in comparison to the cooking according to graph 1500, the cooking time is long, but the power consumption is lowered. Accordingly, in a case where the user desires to suppress the amount of power consumption even if the cooking time is long, cooking is performed using the pattern according to the graph 1600. Meanwhile, in a case where it is desired to suppress the cooking time to be short even if the power consumption is slightly high, cooking is performed using the pattern according to the graph 1500. That is, the user is able to perform cooking by selecting the cooking pattern which is specialized in the matter in which the user prioritizes by confirming the plurality of measurement results of the power consumption in the cooking menu which is the same as shown in FIG. 20.

Furthermore, as understood from FIG. 20, in the cooking according to graph 1500 and the cooking according to graph 1600, the utilized cooking utensils are different. Accordingly, the user is able to determine the pattern of the cooking which adopts the cooking menu while modifying the utensil which is utilized in cooking and confirming a difference of the amount of power consumption with reference to the display which is shown in FIG. 20.

In the relationship on paper, each of FIGS. 19 and 20 indicate that only the information of the pattern of two types of power consumption are simultaneously viewable in the same menu, but a case where three or more patterns are displayed to be simultaneously viewable is also possible. In addition, a case where the plurality of patterns are switchably displayed is also possible.

In addition, a case where the power consumption pattern of the different cooking menus are displayed so as to be simultaneously viewable, or switchable is also possible. The user who references the display is able to select the cooking menu based on the total amount or the pattern of the power consumption. Furthermore, the user is able to select a combination of the menu in which cooking is performed at a simultaneous progression within the plurality of cooking menus based on the total amount and pattern of the power consumption.

In the sixth embodiment, as shown in FIGS. 19 and 20, the information on the power consumption in the selected cooking menu is able to be output not to each procedure, but to the entire cooking menu.

Seventh Embodiment

A seventh embodiment will be described below focusing on differences from the other embodiments in the present specification. When not otherwise specified, it is possible to adopt a configuration which is common with the other embodiments as the configuration of the seventh embodiment.

In the seventh embodiment, the cooking assistance application is installed on the server 900, and is executed by the processor 913 of the server 900. That is, in the seventh embodiment, the cooking assistance application is provided as a so-called cloud application with respect to the tablet terminal 100.

Then, in the seventh embodiment, for example, when execution of the cooking assistance application is instructed in the tablet terminal 100, the instruction is transmitted to the server 900 via the network 800. According to this, on the server 900, the processor 913 starts the cooking assistance application. The output information generating section 913B transmits various information which includes content (refer to FIG. 10) for outputting the explanation of each procedure to the tablet terminal 100. The input information processing section 913A acquires the measurement result of the "power consumption in the cooking by the user" from the repeater 300 via the network 800. The output information generating section 913B further includes the power consumption and the like which is transmitted from the repeater 300, and transmits the information on power consumption in each procedure to the tablet terminal 100.

Eighth Embodiment

An eighth embodiment will be described below focusing on differences from the other embodiments in the present specification. When not otherwise specified, it is possible to adopt a configuration which is common with the other embodiments as the configuration of the eighth embodiment.

In the eighth embodiment, the tablet terminal 100 stores the power consumption pattern in the cooking appliance in cooking according to a recipe which is prepared in advance or in cooking which is performed without a recipe which is prepared in advance.

In more detail, first, the user activates a function of measuring the power consumption of the cooking appliance with respect to the tablet terminal 100. Then, the cooking is performed utilizing the cooking appliance. When the cooking is complete, the user instructs the end of the function of measuring the power consumption with respect to the tablet terminal 100. Thereby, the CPU 110 acquires the power consumption of the cooking appliance of the period after the function activation is instructed to the end being instructed, and the instruction is stored in the memory 140 or the like.

At this time, the user may further input the information which specifies the recipe information with respect to the tablet terminal 100. Thereby, the CPU 110 associates the power consumption of the cooking appliance of the period with the recipe information.

The user may input the information which specifies the information which specifies the period of each procedure (start and end of the period of each procedure) which is included in the recipe information with respect to the tablet terminal 100 during cooking. Such information may be, for example, speech such as "procedure 2, start" and "procedure 2 end". The CPU 110 may have the speech recognition function. Then, the CPU 110 associates the power consumption with each procedure which is included in the recipe information so as to indicate the power consumption of the cooking appliance of the period as graph 1300 in FIG. 19 according to the input. Here, after the cooking ends, the user may input the information which specifies the period of each procedure with respect to the mic 180, the touch panel 122, or the like of the tablet terminal 100. In this case, the CPU 110 associates the power consumption with each procedure which is included in the recipe information so as to indicate the power consumption of the cooking appliance of the period as graph 1300 in FIG. 19.

Furthermore, the CPU 110 is able to register the pattern of the power consumption which is stored so as to be associated in the recipe information in the memory 140 or the like on the server 900 so as to be associated with the user of the tablet terminal 100. Thereby, the pattern is able to be common between the plurality of users of the network system in FIG. 1.

It is considered that the embodiment which is currently disclosed and modification examples thereof are not limited to the exemplifications. The scope of the present invention is indicated by the claims and not the description above, and the meaning equivalent to the claims and all modifications within the scope of the claims are intended to be included.

In each embodiment, control is described based on the power value which is measured by the cooking appliance such as the microwave oven. Here, the measurement value which is utilized in control may be a power amount or the like as long as the value relates to the power consumption of the cooking appliance.

In addition, in each embodiment, the power consumption is described so as to be displayed by being stored to be associated with the procedure in the recipe information. Here the power consumption may be displayed so as to be associated with at least the elapsed time of cooking. That is, the model data (refer to FIG. 10) and data of other users (refer to FIG. 17) in each embodiment may be data which is associated with at least cooking, and associated with the information which relates to the power consumption. That is, the model data and the data of other users need not be associated with the recipe information or the elapsed time from the start of cooking. The model data and the data of other users may be, for example, information "after cooking for three hours at an output of 900 W, cooking for five hours at an output if 600 W" which relates to the power consumption which is associated with each "cooking A" pattern. The power which is consumed in the cooking by the user of the tablet terminal 100 is able to be displayed, or compared alongside the model data or the data of other users which is stored in this manner. Furthermore, the model data or the data of other users may include output levels ("high", "low", "heating power 1", "heating power 2", "heating power 3", and the like) in the cooking appliance and corresponds to the value of the power consumption in place of the value of the power consumption ("900 W" and "600 W" described above).

REFERENCE SIGNS LIST

100 TABLET TERMINAL
120 TOUCH SCREEN
121 DISPLAY
122 TOUCH PANEL
160 COMMUNICATION INTERFACE
170 SPEAKER
180 MICROPHONE
200 BROADBAND ROUTER
300 REPEATER
900 SERVER

The invention claimed is:

1. A cooking assistance device for providing information, the information assisting cooking using a cooking appliance based on a measurement result of power consumption of the cooking appliance, comprising:

a storage unit storing information related to power consumption in cooking;

an acquisition unit acquiring a measurement value related to power consumption of the cooking appliance;

an output unit outputting the measurement value, the information related to power consumption in cooking, and recipe information; and a measurement device, the measurement device measuring power consumption of the cooking appliance;

wherein the information related to power consumption in cooking is associated with the recipe information;

wherein the measurement value is a value relating to power consumption of the cooking appliance in a period corresponding to the recipe information;

wherein the recipe information includes cooking information on a plurality of procedures;

wherein the information related to power consumption in cooking includes a value, the value relating to power consumption relates to cooking corresponding to at least one procedure among the plurality of procedures; and wherein the measurement value relates to at least one of the plurality of procedures.

2. The cooking assistance device according to claim 1, wherein the information related to power consumption in cooking includes a value, the value relates to power consumption by each of the two or more cooking devices, the two or more cooking devices relate to cooking corresponding to the recipe information, and the acquisition unit acquires a value, the value relates to the power consumption by each of the two or more cooking devices as the measurement value.

3. The cooking assistance device according to claim 1, further comprising:

an input unit receiving input of information, the information specifying recipe information; and a control unit storing in the storage unit, the measurement value acquired by the acquisition unit, and the recipe information input to the input unit, while associating the measurement value and the recipe information with each other.

4. A cooking assistance method executed by a cooking assistance device for providing information, the information assisting cooking using a cooking appliance based on a measurement result of power consumption of the cooking appliance, the cooking assistance device including a storage unit, an output unit, and a measurement device, the storage unit storing information related to power consumption in cooking, the measurement device measuring power consumption of the cooking appliance, the method comprising the steps of:

acquiring a measurement value related to the power consumption of the cooking appliance; and outputting the measurement value, the information related to power consumption in cooking, and recipe information by the output unit;

wherein the recipe information includes a first procedure and a second procedure, the second procedure is a subsequent procedure to the first procedure; and the output unit outputs the second procedure in the recipe information after the first procedure is determined to be completed in the cooking appliance based on comparison between the measurement value and the information related to power consumption in cooking.

5. A cooking assistance device for providing information, the information assisting cooking using a cooking appliance based on a measurement result of power consumption of the cooking appliance, comprising:

a storing unit storing information related to power consumption in cooking;

an acquisition unit acquiring a measurement value related to power consumption of the cooking appliance;

an output unit outputting recipe information; and a measurement device, the measurement device measuring power consumption of the cooking appliance;

wherein the recipe information includes a first procedure and a second procedure, the second procedure is a subsequent procedure to the first procedure, and the output unit outputs the second procedure in the recipe information after it is determined that the first procedure is completed in the cooking appliance based on comparison between the measurement value and the information related to power consumption in cooking.

6. A cooking assistance system for providing information, the information assisting cooking using a cooking appliance based on a measurement result of power consumption of the cooking appliance, comprising:

a server;

an output device; and a measurement device measuring power consumption of the cooking appliance, wherein the measurement device includes a measurement unit measuring a value related to power consumption of the cooking appliance, and a first transmission unit transmitting a measurement result by the measurement unit to the server, and wherein the server includes a storage unit storing information related to power consumption in cooking, an acquisition unit acquiring a measurement value related to power consumption of the cooking appliance from the measurement result;

an output unit outputting recipe information; and a second transmission unit transmitting data for outputting the measurement value and the information related to power consumption in cooking to the output device;

wherein the recipe information includes a first procedure and a second procedure, the second procedure is a subsequent procedure to the first procedure; and the output unit outputs the second procedure in the recipe information after the first procedure is determined to be completed in the cooking appliance based on comparison between the measurement value and the information related to power consumption in cooking.

* * * * *